US011127526B2

(12) United States Patent
Tanaka

(10) Patent No.: US 11,127,526 B2
(45) Date of Patent: Sep. 21, 2021

(54) INDUCTOR COMPONENT

(71) Applicant: Murata Manufacturing Co., Ltd., Kyoto-fu (JP)

(72) Inventor: Akira Tanaka, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 297 days.

(21) Appl. No.: 15/956,624

(22) Filed: Apr. 18, 2018

(65) Prior Publication Data

US 2018/0308624 A1 Oct. 25, 2018

(30) Foreign Application Priority Data

Apr. 25, 2017 (JP) ..... JP2017-086206

(51) Int. Cl.

| | |
|---|---|
| ***H01F 17/04*** | (2006.01) |
| ***H01F 27/29*** | (2006.01) |
| ***H01F 27/02*** | (2006.01) |
| ***H01F 27/28*** | (2006.01) |
| ***H01F 27/26*** | (2006.01) |
| ***H01F 27/38*** | (2006.01) |

(52) U.S. Cl.

CPC ..... *H01F 27/292* (2013.01); *H01F 17/045* (2013.01); *H01F 27/022* (2013.01); *H01F 27/26* (2013.01); *H01F 27/2828* (2013.01); *H01F 27/38* (2013.01)

(58) Field of Classification Search

CPC ..... H01F 27/2823; H01F 27/29
USPC ..... 336/221
See application file for complete search history.

(56) References Cited

U.S. PATENT DOCUMENTS

| | | | | |
|---|---|---|---|---|
| 7,933,113 | B2 * | 4/2011 | Motoki | H01G 4/30 361/309 |
| 2002/0180574 | A1 | 12/2002 | Toi et al. | |
| 2007/0063804 | A1 | 3/2007 | Watanabe | |
| 2017/0018351 | A1 | 1/2017 | Yatabe et al. | |
| 2017/0125157 | A1 | 5/2017 | Hess et al. | |
| 2017/0154728 | A1 | 6/2017 | Horiuchi | |
| 2017/0263372 | A1 * | 9/2017 | Ashizawa | H01F 27/006 |
| 2017/0263382 | A1 | 9/2017 | Kurokawa et al. | |
| 2017/0365399 | A1 * | 12/2017 | Kobayashi | H01F 17/045 |
| 2018/0308621 | A1 | 10/2018 | Tanaka et al. | |
| 2019/0318863 | A1 * | 10/2019 | Konishi | H01F 41/0206 |

FOREIGN PATENT DOCUMENTS

| | | | |
|---|---|---|---|
| CN | 1286480 | A | 3/2001 |
| CN | 108735425 | A | 11/2018 |
| JP | S60176517 | U | 11/1985 |

(Continued)

OTHER PUBLICATIONS

English translation of JP2002329618 (Year: 2002).*

(Continued)

*Primary Examiner* — Ronald Hinson
(74) *Attorney, Agent, or Firm* — Studebaker & Brackett PC

(57) ABSTRACT

An inductor component includes a core including a substantially column-shaped shaft and a support formed on an end portion of the shaft, a terminal electrode formed on the support, and a cover member that covers at least an upper face of the shaft. A width dimension of the inductor component including the core and the terminal electrode is greater than a width dimension of the cover member.

20 Claims, 11 Drawing Sheets

(56) References Cited

FOREIGN PATENT DOCUMENTS

| | | | |
|---|---|---|---|
| JP | H0357920 | U | 6/1991 |
| JP | H10135048 | A | 5/1998 |
| JP | H10-321438 | A | 12/1998 |
| JP | 2000306757 | A | 11/2000 |
| JP | 2002057053 | A | 2/2002 |
| JP | 2002198229 | A | 7/2002 |
| JP | 2002-280226 | A | 9/2002 |
| JP | 2002329618 | A | 11/2002 |
| JP | 2004311755 | A | 11/2004 |
| JP | 2005317591 | A | 11/2005 |
| JP | 2007088134 | A | 4/2007 |
| JP | 2007134398 | A | 5/2007 |
| JP | 2011-216539 | A | 10/2011 |
| JP | 2014216347 | A | 11/2014 |
| JP | 2015053495 | A | 3/2015 |
| JP | 2016058471 | A | 4/2016 |
| JP | 3204112 | U | 5/2016 |
| JP | 2017022304 | A | 1/2017 |
| WO | 2016027659 | A1 | 2/2016 |

OTHER PUBLICATIONS

English translation of JP2005026365 (Year: 2005).*
English translation of JP2012029210 (Year: 2012).*
An Office Action; "Notification of Reasons for Refusal," Mailed by the Japanese Patent Office dated Jul. 2, 2019, which corresponds to Japanese Patent Application No. 2017-086206 and is related to U.S. Appl. No. 15/956,624; with English language translation.
An Office Action issued by the State Intellectual Property Office of the People's Republic of China dated Apr. 16, 2020, which corresponds to Chinese Patent Application No. 201810366020.9 and is related to U.S. Appl. No. 15/956,624 with English language translation.

* cited by examiner

INDUCTOR COMPONENT

CROSS-REFERENCE TO RELATED APPLICATION

This application claims benefit of priority to Japanese Patent Application No. 2017-086206, filed Apr. 25, 2017, the entire content of which is incorporated herein by reference.

BACKGROUND

Technical Field

The present disclosure relates to an inductor component including a core and a wire wound around the core.

Background Art

Various types of inductor components are mounted in electronic devices. A wire-wound inductor component includes a core and a wire wound around the core. The end portions of the wire are connected to terminal electrodes formed on the core (see, for example, Japanese Unexamined Patent Application Publications Nos. 2002-280226 and 10-321438). Each terminal electrode is connected to a pad by, for example, solder, the pad being formed on a circuit board or the like on which the inductor component is mounted.

SUMMARY

Electronic devices, such as cellular phones, have become smaller, and there has been a demand for smaller inductor components to be mounted in such an electronic device. When an inductor component is reduced in size, the areas of terminal electrodes of the inductor component are reduced accordingly, and the inductor component is easily inclined with respect to an object. Thus, there is a risk that the inductor component and a device adjacent to the inductor component, for example, will interfere with each other.

The present disclosure provides an inductor component that does not easily interfere with a component adjacent thereto.

According to one embodiment of the present disclosure, an inductor component includes a core including a substantially column-shaped shaft and a support formed on an end portion of the shaft; a terminal electrode formed on the support; a wire wound around the shaft and including an end portion connected to the terminal electrode; and a cover member that covers at least an upper face of the shaft. The terminal electrode includes a bottom electrode section on a bottom face of the support, a side electrode section on a side face of the support, and an end electrode section on an end face of the support. A width dimension of the inductor component including the core and the terminal electrode is greater than a width dimension of the cover member.

The inductor component having this structure can be easily placed in a stable position in the mounting process. In addition, the gap between the inductor component mounted on the circuit board and a component mounted adjacent to the inductor component can be increased at the top side. Thus, the risk of interference between the components due to, for example, tilting of the components can be reduced.

A length dimension of the above-described inductor component including the core and the terminal electrode is preferably greater than a length dimension of the cover member. The inductor component having this structure can be more easily placed in a stable position in the mounting process.

In the above-described inductor component, the cover member preferably covers a top face of the support. The inductor component having this structure can be easily mounted by using the cover member.

In the above-described inductor component, preferably, a length dimension of the inductor component including the core and the terminal electrode is less than or equal to about 1.0 mm, a width dimension of the inductor component including the core and the terminal electrode is less than or equal to about 0.6 mm, and a height dimension of the inductor component including the core and the terminal electrode is less than or equal to about 0.8 mm.

With this structure, the size of the inductor component is reduced. Accordingly, the effect of reducing the occurrence of interference between the inductor component and a device adjacent thereto can be more effective.

A height dimension of the above-described inductor component including the core and the terminal electrode is preferably greater than a width dimension of the inductor component including the core and the terminal electrode. With this structure, the height of the terminal electrode can be increased relative to a certain mounting area, and the surface area of the terminal electrode can be increased accordingly. When the surface area is increased, the terminal electrode can be strongly connected to a circuit board. In other words, the fixing force between the inductor component and the circuit board can be increased.

In the above-described inductor component, an end portion of the end electrode section adjacent to the side face is preferably higher than an end portion of the side electrode section adjacent to the end face. With this structure, the surface area of the end electrode section can be increased.

In the above-described inductor component, a central portion of the end electrode section is preferably higher than the end portion of the end electrode section. In this structure, the surface area of the end electrode section is greater than that in the case where the central portion and the end portion have the same height.

In the above-described inductor component, preferably, a top edge of the end electrode section is substantially upwardly convex arc-shaped. With this structure, the surface area of the end electrode section can be further increased.

In the above-described inductor component, a height of the side electrode section preferably increases from an inner face of the support toward the end face of the support. With this structure, the terminal electrode is lower at the end adjacent to the inner face than at the end adjacent to the end face. Therefore, even when the height of the end electrode section is increased, the risk of interference between the wire and solder in the region near the inner face can be reduced in the mounting process.

In the above-described inductor component, the support preferably includes a first ridge that is rounded at a boundary between an inner face of the support and the bottom face, and a second ridge that is rounded at a boundary between the bottom face and the end face. Preferably, a radius of curvature of the first ridge is greater than the radius of curvature of the second ridge. With this structure, the wire is curved with a large radius of curvature at the first ridge, so that the occurrence of breakage of the wire can be reduced.

In the above-described inductor component, the radius of curvature of the first ridge is preferably greater than the radius of curvature of the second ridge by an amount greater than or equal to about 9% of the radius of curvature of the second ridge. With this structure, the occurrence of breakage of the wire included in the inductor component can be more reliably reduced.

In the above-described inductor component, the inner face of the support is preferably vertical between the first ridge and the shaft. This structure provides a larger space for winding the wire in the region near the inner face of the support.

In the above-described inductor component, preferably, the support includes a third ridge that is rounded at a boundary between a top face of the support and the inner face, and a fourth ridge that is rounded at a boundary between the top face and the end face, and a radius of curvature of the third ridge is greater than a radius of curvature of the fourth ridge. With this structure, the manufacturing process can be facilitated.

In the above-described inductor component, preferably, the terminal electrode includes an underlying layer on a surface of the support and a plated layer on a surface of the underlying layer, and a maximum thickness of the underlying layer on the end face of the support is greater than a maximum thickness of the underlying layer on the bottom face of the support. With this structure, the adhesion between the underlying layer on the end face and the end face can be increased, and the surface area of the end electrode section can be increased.

In the above-described inductor component, preferably, the support has a ridge that is rounded at a boundary between the bottom face and the end face, and a radius of curvature of the ridge is greater than or equal to about 20 μm. With this structure, the underlying layer on the bottom face and the underlying layer on the end face are not easily disconnected.

In the above-described inductor component, preferably, the core includes another support that are formed on another end portion of the shaft, the inductor component further includes another terminal electrode formed on the another support, and the terminal electrode on the support and the another terminal electrode on the another support have different shapes. With this structure, the design flexibility of the terminal electrodes of the inductor component and the land pattern on the circuit board can be increased.

In the above-described inductor component, an end portion of the side electrode section adjacent to the end face is preferably higher than a bottom face of the shaft. With this structure, the end electrode section connected to the side electrode section can be formed to have a larger surface area than that in a common terminal electrode.

In the above-described inductor component, preferably, the side electrode section includes two portions having different inclinations, and an inclination of one of the two portions that is adjacent to the end face is greater than an inclination of other of the two portions that is adjacent to an inner face of the support. With this structure, the design flexibility of the terminal electrode of the inductor component and the land pattern on the circuit board can be increased.

In the above-described inductor component, preferably, the side electrode section includes two portions having different inclinations, and an inclination one of the two portions that is adjacent to an inner face of the support is greater than an inclination of other of the two portions that is adjacent to the end face. With this structure, the design flexibility of the terminal electrode of the inductor component and the land pattern on the circuit board can be increased.

In the above-described inductor component, the terminal electrode preferably includes a ridge electrode section between the side electrode section and the end electrode section on a ridge at a boundary between the side face and the end face, the ridge electrode section having an inclination greater than an inclination of the side electrode section. With this structure, the surface area of the end electrode section can be further increased.

The inductor component according to the embodiments of the present disclosure does not easily interfere with a component adjacent thereto.

Other features, elements, characteristics and advantages of the present disclosure will become more apparent from the following detailed description with reference to the attached drawings.

DETAILED DESCRIPTION

Embodiments of the present disclosure will now be described.

In the accompanying drawings, the constituent elements may be enlarged to facilitate understanding. The dimensional ratios between the constituent elements may differ from the actual ratios or those in other figures. Although some constituent elements are hatched in sectional views to facilitate understanding, hatching may be omitted.

First Embodiment

A first embodiment will now be described.

Figure 1B:
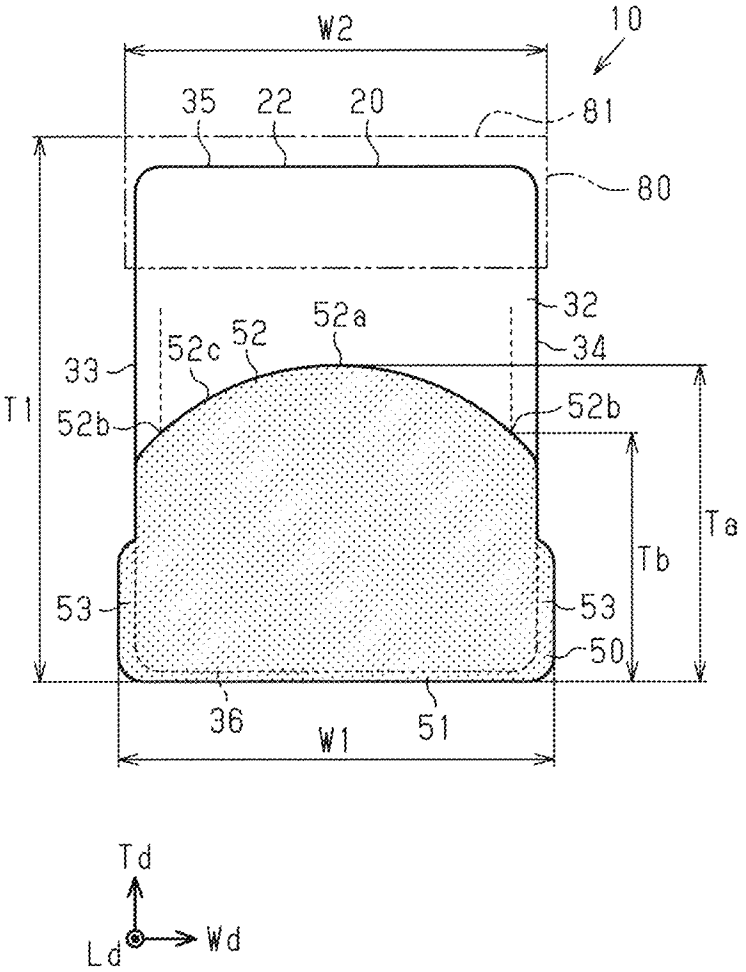
FIG. 1B is an end view of the inductor component.
Figure 1A:
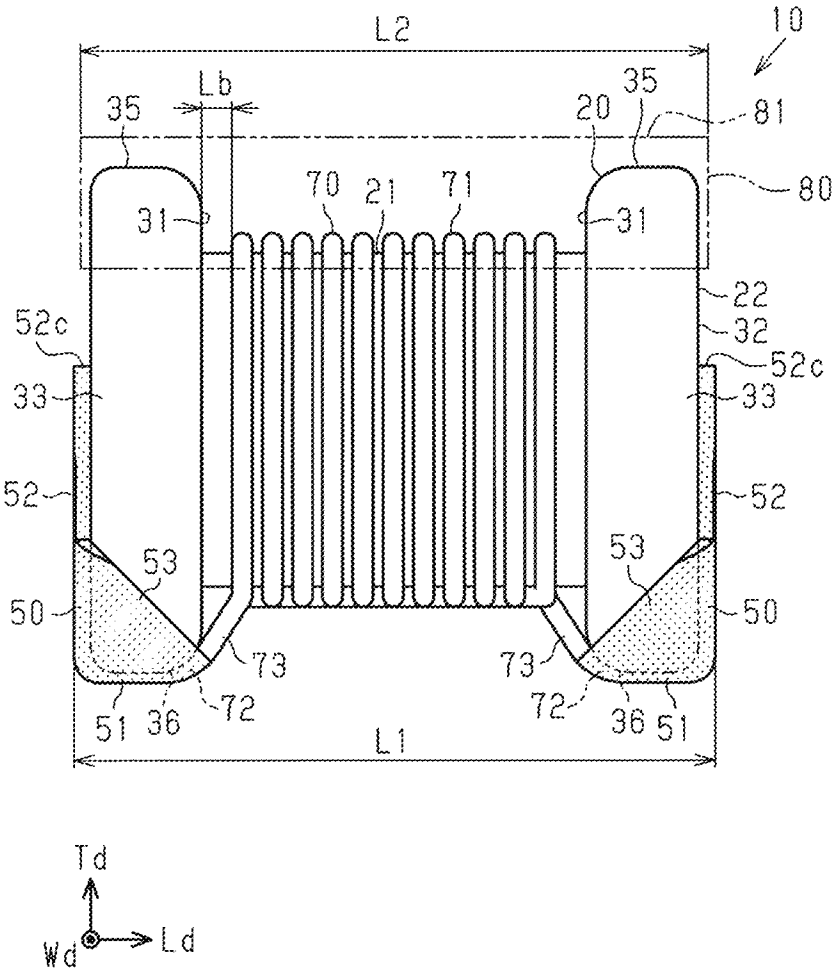
FIG. 1A is a front view of an inductor component according to a first embodiment.
Figure 2:
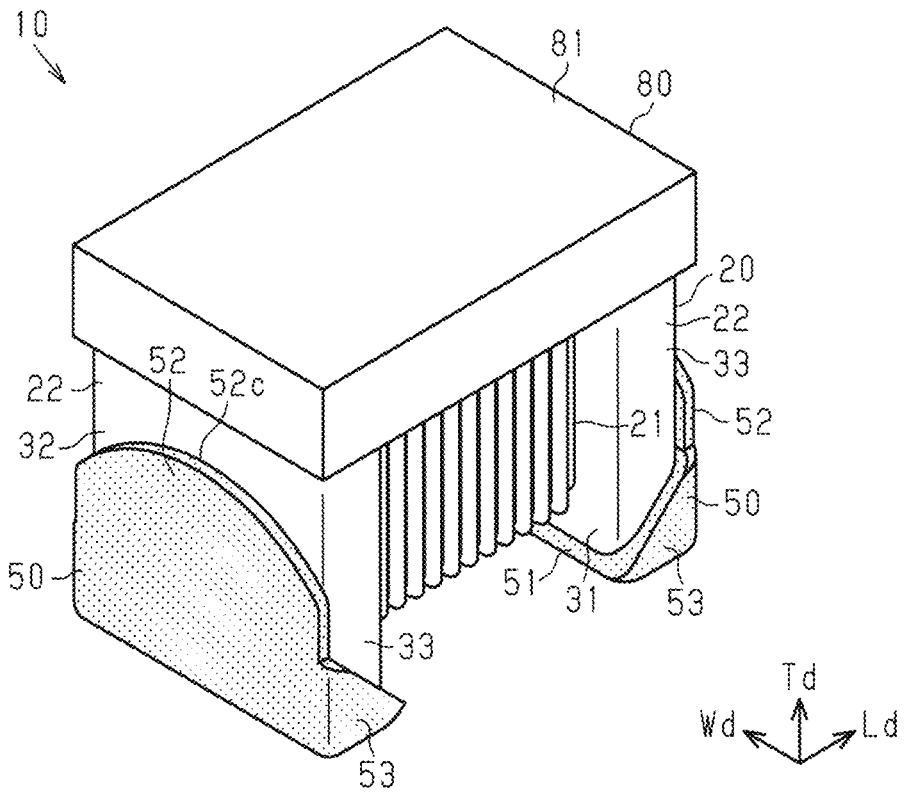
FIG. 2 is a perspective view of the inductor component according to the first embodiment.

An inductor component 10 illustrated in FIGS. 1A, 1B, and FIG. 2 is, for example, a surface-mount inductor component to be mounted on, for example, a circuit board. The inductor component 10 may be used in various devices, such as smart phones and wrist-worn mobile electronic devices (for example, smart watches).

The inductor component 10 according to the present embodiment includes a core 20, a pair of terminal electrodes 50, and a wire 70. The core 20 includes a shaft 21 and a pair of supports 22. The shaft 21 is substantially rectangular parallelepiped shaped (rectangular prism shaped). The supports 22 extend perpendicularly to the longitudinal direction of the shaft 21 from both ends of the shaft 21. The shaft 21 is supported parallel to a circuit board by the supports 22. The supports 22 are formed integrally with the shaft 21 at both ends of the shaft 21.

The terminal electrodes 50 are formed on the respective supports 22. The wire 70 is wound around the shaft 21 so as to form a single layer on the shaft 21. Both end portions of the wire 70 are connected to the respective terminal electrodes 50. The inductor component 10 is a wire-wound inductor component.

The inductor component 10 is substantially rectangular parallelepiped shaped. In this specification, the term "rectangular parallelepiped shape" covers the shapes of rectangular parallelepipeds having beveled or rounded corners or ridges. Also, the principal faces and side faces may be uneven either locally or over the entire area thereof. The term "rectangular parallelepiped shape" also covers the shapes in which opposing faces are not exactly parallel but are somewhat inclined relative to each other.

In this specification, the longitudinal direction of the shaft 21 is defined as a "length direction Ld". Among the directions perpendicular to the "length direction Ld", the vertical direction in FIGS. 1A and 1B is defined as a "height direction (thickness direction) Td", and the direction perpendicular to the "length direction Ld" and the "height direction Td" (horizontal direction in FIG. 1B) is defined as a "width direction Wd". In this specification, among the directions perpendicular to the length direction, the "width direction" is the direction parallel to the circuit board in the state in which the inductor component 10 is mounted on the circuit board.

The dimension of the inductor component 10 in the length direction Ld (length dimension L1) is preferably greater than about 0 mm and less than or equal to about 1.0 mm (i.e., from greater than about 0 mm to about 1.0 mm). In the present embodiment, the length dimension L1 of the inductor component 10 is, for example, about 0.7 mm.

The dimension of the inductor component 10 in the width direction Wd (width dimension W1) is preferably greater than about 0 mm and less than or equal to about 0.6 mm (i.e., from greater than about 0 mm to about 0.6 mm). The width dimension W1 is preferably less than or equal to about 0.36 mm, and more preferably less than or equal to about 0.33 mm. In the present embodiment, the width dimension W1 of the inductor component 10 is, for example, about 0.3 mm.

The dimension of the inductor component 10 in the height direction Td (height dimension T1) is preferably greater than about 0 mm and less than or equal to about 0.8 mm (i.e., from greater than about 0 mm to about 0.8 mm). In the present embodiment, the height dimension T1 of the inductor component 10 is, for example, about 0.5 mm.

As illustrated in FIG. 2, the shaft 21 is substantially rectangular parallelepiped shaped and extends in the length direction Ld. The supports 22 are plate-shaped and are thin in the length direction Ld. The supports 22 are rectangular parallelepiped shaped and are longer in the height direction Td than in the width direction Wd.

The supports 22 protrude around the shaft 21 in the height direction Td and the width direction Wd. More specifically, when viewed in the length direction Ld, each support 22 is shaped so as to protrude from the shaft 21 in the height direction Td and the width direction Wd.

Each support 22 includes an inner face 31 and an end face 32 that oppose each other in the length direction Ld; a pair of side faces 33 and 34 that oppose each other in the width direction Wd; and a top face 35 and a bottom face 36 that oppose each other in the height direction Td. The inner face 31 of one support 22 opposes the inner face 31 of the other support 22. As illustrated in the drawings, in this specification, the term "bottom face" means a face that opposes the circuit board when the inductor component is mounted on the circuit board. In particular, the bottom face of each support is the face on which a terminal electrode is formed. The term "top face" means a face that opposes the "bottom face". The term "end face" means the face of each support that faces away from the shaft. The term "side face" means a face adjacent to a bottom face and an end face.

Examples of the material of the core 20 include magnetic materials (for example, nickel-zinc (Ni—Zn) ferrites and manganese-zinc (Mn—Zn) ferrites), alumina, and metal magnetic substances. The core 20 can be formed by compression molding and sintering by using powder of the above-mentioned materials.

Figure 4:
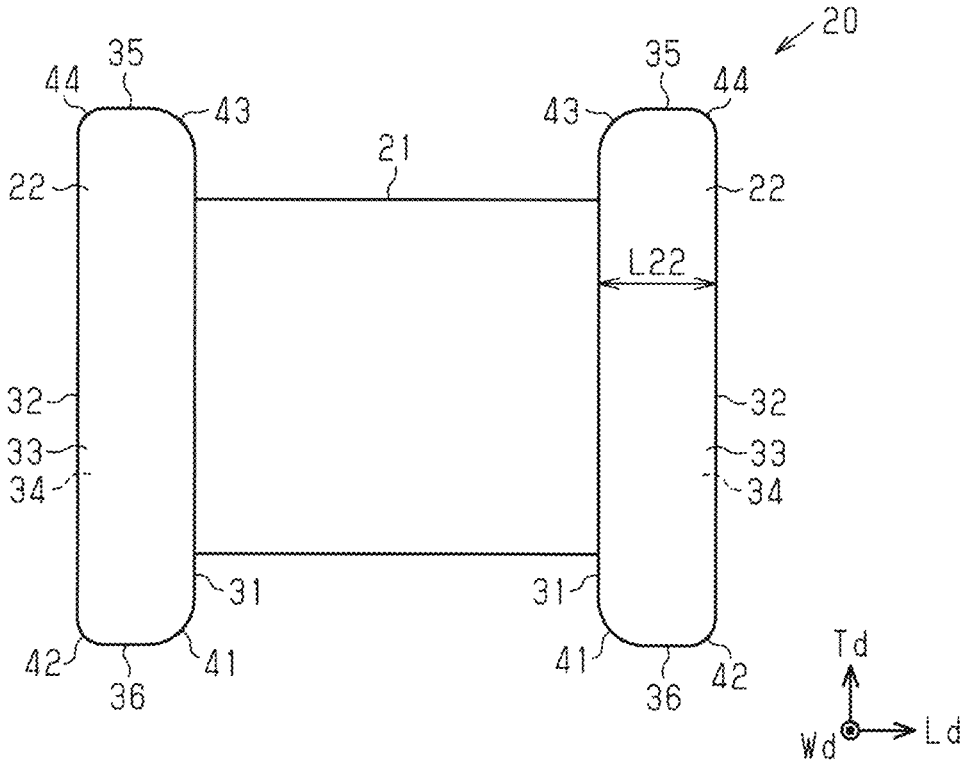
FIG. 4 is a side view of the core.

As illustrated in FIG. 4, each support 22 includes a ridge 41 (first ridge) at the boundary between the inner face 31 and the bottom face 36, and a ridge 42 (second ridge) at the boundary between the end face 32 and the bottom face 36. The surfaces of the ridges 41 and 42 are curved convexly toward the outside of the core 20, and are substantially cylindrical (convexly cylindrical). Similarly, each support 22 includes a ridge 43 (third ridge) at the boundary between the top face 35 and the inner face 31, and a ridge 44 (fourth ridge) at the boundary between the top face 35 and the end face 32. The surfaces of the ridges 43 and 44 are curved convexly toward the outside of the core 20, and are substantially cylindrical (convex cylindrical). Although not illustrated in FIG. 4, each support 22 also includes rounded ridges at the boundaries between the inner face 31 and the side faces 33 and 34 and rounded ridges at the boundaries between the end face 32 and the side faces 33 and 34.

The substantially cylindrical surfaces of the ridges 41 to 44 are arc-shaped in side view. The radii of curvature of the ridges 41 and 43 adjacent to the inner face 31 are greater than those of the ridges 42 and 44 adjacent to the end face 32. For example, the radii of curvature of the ridges 41 and 43 are preferably greater than those of the ridges 42 and 44 by about 9% or more of the radii of curvature of the ridges 42 and 44. Multiple inductor components having this structure caused no wire breakage. The radii of curvature of the ridges 42 and 44 are preferably greater than or equal to about 20 μm. For example, the radii of curvature of the ridges 42 and 44 are preferably in the range of about 20 μm to about 40 μm, and the radii of curvature of the ridges 41 and 43 are preferably in the range of about 25 μm to about 50 μm.

The radii of curvature of the ridges 41 to 44 are set so that the top face 35 and the bottom face 36 of the support 22 are substantially flat. A thickness dimension L22 of the support 22 (thickness in the length direction Ld) is preferably in the range of about 50 μm to about 150 μm. For example, the thickness dimension of the support 22 is about 100 μm, the radius of curvature of the ridge 41 is about 40 μm, and the radius of curvature of the ridge 42 is about 35 μm. In the present embodiment, the radius of curvature of the ridge 43 adjacent to the inner face 31 is greater than the radius of curvature of the ridge 44 adjacent to the end face 32. For example, the radius of curvature of the ridge 43 is about 40 μm, and the radius of curvature of the ridge 44 is about 35 μm.

When the radii of curvature of the ridges 41 and 43 adjacent to the inner face 31 are greater than those of the ridges 42 and 44 adjacent to the end face 32, the manufacturing process of the inductor component 10 can be facilitated. The inductor component 10 includes the terminal electrodes 50 on the bottom faces 36 of the core 20. For the reasons described below, each terminal electrode 50 is formed at the side at which the radius of curvature of the ridge adjacent to the inner face 31 is greater than that of the ridge adjacent to the end face 32. If the above-described relationship between the radii of curvature is satisfied at only one of the top face 35 and the bottom face 36, the side at which the terminal electrode 50 is to be formed needs to be determined, and the core 20 needs to be held in accordance with the result of the determination, which takes a long time. The core 20 according to the present embodiment enables the terminal electrode 50 to be formed thereon without the determination step, and thus the manufacturing process can be facilitated. In the present embodiment, among the two faces that oppose each other in the height direction Td, the face on which the terminal electrode 50 is formed is the bottom face 36, and the face that opposes the bottom face 36 is the top face 35. When it is not necessary to achieve the above-described effect, the radii of curvature of the ridges adjacent to the top face 35 do not need to satisfy the above-described relationship.

In the inductor component 10, the terminal electrodes 50 are not formed on the top faces 35 of the supports 22. In other words, the terminal electrodes 50 of the inductor component 10 are formed on the bottom faces 36. The inductor component 10 having such a structure has a low center of gravity, and therefore can be easily placed in a stable position in the mounting process. When it is not necessary to achieve such an effect, the terminal electrodes 50 may be additionally formed on the top faces 35.

In the inductor component 10, the inner faces 31 of the supports 22 are perpendicular to the bottom faces 36. In other words, the inner faces 31 of the supports 22 are vertical between the shaft 21 and the ridges 41. This structure provides a larger region (space) for winding the wire 70 around the shaft 21 near the inner faces 31 of the supports 22.

Figure 3:
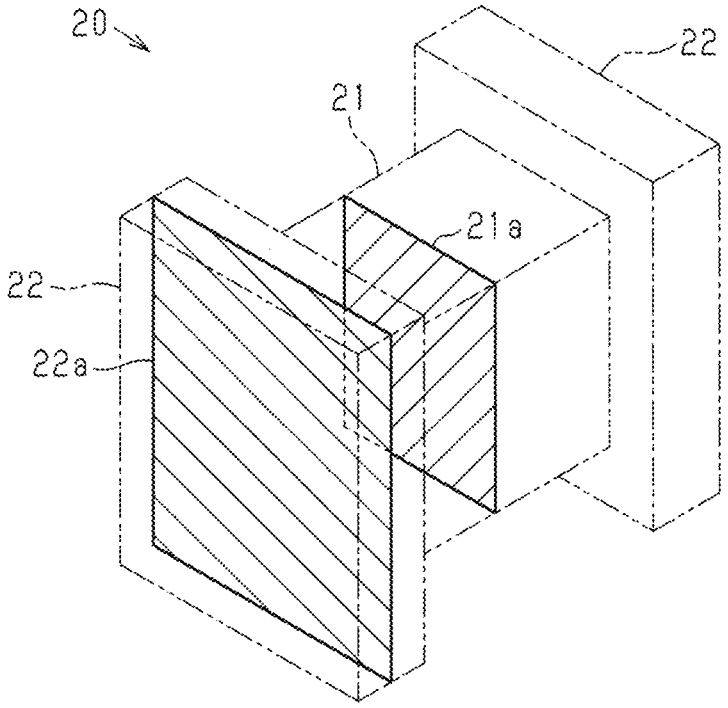
FIG. 3 is a schematic perspective view illustrating cross sections of a core.

Referring to FIG. 3, the area of a cross section 21*a* of the shaft 21 taken perpendicular to the axial direction (length direction Ld) is preferably in the range of about 35% to about 75%, and more preferably about 40% to about 70%, of the area of a cross section 22*a* of each support 22 taken perpendicular to the axial direction. The area of the cross section 21*a* of the shaft 21 is more preferably in the range of about 45% to about 65%, and still more preferably in the range of about 50% to about 60%, of the area of the cross section 22*a* of each support 22. In the present embodiment, the area of the cross section 21*a* of the shaft 21 is about 55% of the area of the cross section 22*a* of the support 22.

When the ratio of the cross-sectional area of the shaft 21 to the cross-sectional area of each support 22 is set in a predetermined range as described above, the design flexibility of the inductor component 10 (core 20) can be increased by using the space between the shaft 21 and the end portions of the supports 22 in the directions perpendicular to the length direction Ld (width direction Wd and height direction Td). When, for example, the ratio of the cross-sectional area of the shaft 21 to the cross-sectional area of each support 22 is greater than a certain ratio, the strength of the core 20 can be increased. In addition, the amount of saturation of magnetic flux that passes through the core 20 can be increased, which leads to less degradation in characteristics. When the ratio of the cross-sectional area of the shaft 21 to the cross-sectional area of each support 22 is large, there is a risk that the wire 70 wound around the core 20 will protrude from the end portions of the supports 22.

The design flexibility may be such that the position of the shaft 21 relative to each support 22 may be set. The characteristics of the inductor component 10 may be set in accordance with the position of the shaft 21. For example, when the shaft 21 is at a high position, the amount of parasitic capacitance between the wire 70 and each of the wires and pads on the circuit board having the inductor component 10 mounted thereon can be reduced. Accordingly, the self-resonance frequency can be increased. When the shaft 21 is at a low position, the inner faces 31 of the supports 22 oppose each other over a large area above the shaft 21. Therefore, magnetic flux is easily generated between the supports 22. Accordingly, the inductance can be set to a desired value, and the impedance can be increased.

As illustrated in FIGS. 1A and 1B, each terminal electrode 50 includes a bottom electrode section 51 formed on the bottom face 36 of the corresponding support 22. The bottom electrode section 51 is formed over the entire area of the bottom face 36 of the support 22.

Each terminal electrode 50 also includes an end electrode section 52 formed on the end face 32 of the corresponding support 22. The end electrode section 52 is formed so as to cover a portion (lower portion) of the end face 32 of the support 22. The end electrode section 52 is connected to the bottom electrode section 51 by a portion of the terminal electrode 50 on the ridge 42 between the end face 32 and the bottom face 36.

Figure 17:
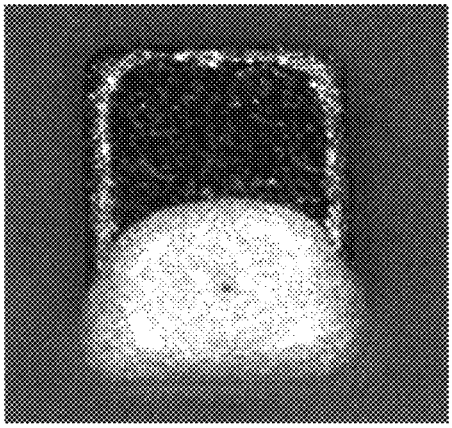
FIG. 17 is a photograph of an end face of a core.

As illustrated in FIG. 1B, a central portion 52*a* of the end electrode section 52 is higher than an end portions 52*b* of the end electrode section 52 positioned in the width direction Wd. A top edge 52*c* of the end electrode section 52 is substantially upwardly convex arc-shaped. The end portion 52*b* of the end electrode section 52 adjacent to the side face 33 is higher than an end portion of a side electrode section 53 on the side face 33 adjacent to the end face 32. FIG. 17 is an enlarged photograph of the core and the end electrode section.

The ratio of a height Ta of the central portion 52*a* of the end electrode section 52 to a height Tb of the end portions 52*b* of the end electrode section 52 is preferably greater than or equal to about 1.1, and more preferably greater than or equal to about 1.2. In the present embodiment, the height ratio is greater than or equal to about 1.3. When viewed in a direction perpendicular to the end face 32, the height of the end electrode section 52 is a length from the surface (bottom end) of the bottom electrode section 51 to the edge (top end) of the end electrode section 52 in the height direction Td. In particular, the height Tb of the end portions 52*b* is the height at the ends of the end face 32, which is substantially flat, in the width direction Wd.

In FIG. 1B, the ends of the substantially flat end face 32 are indicated by broken lines. The core 20 has a ridge that is rounded at the boundary between the side face 33 and the end face 32. The ridge is formed by, for example, barrel finishing. The position of the bottom end varies at the ridge, and accordingly the height of the end electrode section 52 easily varies. Therefore, the end portions 52*b* of the end electrode section 52 are defined as the portions at the ends of the substantially flat end face 32 in the width direction Wd. In the case where the substantially flat end face 32 does not have clear ends, the end portions 52*b* may be defined as portions that are about 50 μm inward from the side faces 33 and 34 of the support 22 in FIG. 1B.

The width dimension W1 and the height dimension T1 of the inductor component 10 are preferably such that the height dimension T1 is greater than the width dimension W1 (T1>W1). In such a case, the height of the end electrode section 52 can be increased relative to a certain mounting area, and the surface area of the end electrode section 52 can be increased accordingly. As a result, the fixing force can be increased.

As illustrated in FIG. 1B, each terminal electrode 50 also includes side electrode sections 53 formed on the side faces 33 and 34 of the corresponding support 22. As illustrated in FIG. 1A, the side electrode sections 53 of the terminal electrodes 50 cover portions (lower portions) of the side faces 33 of the respective supports 22. The side electrode sections 53 are connected to the bottom electrode sections 51 and the end electrode sections 52 by portions of the terminal electrodes 50 on the ridges. The side electrode sections 53 are formed so that the heights thereof gradually increase with increasing distances from the opposing inner faces 31 toward the end faces 32 of the supports 22, that is, so that the top edges of the terminal electrodes 50 are inclined on the side faces 33 of the supports 22. In the present embodiment, end portions of the side electrode sections 53 that are adjacent to the end faces 32 extend to a position higher than the bottom face of the shaft 21 with respect to the bottom face 36 of the corresponding support 22. Although the side electrode sections 53 on the side faces 33 are illustrated in FIG. 1A, the side electrode sections on the side faces 34 illustrated in FIG. 1B have a similar structure. As described above, the bottom electrode sections 51, the end electrode sections 52, and the side electrode sections 53 do not include portions of the terminal electrodes 50 on the ridges between the end faces 32, the side faces 33 and 34, and the bottom faces 36.

Figure 5:
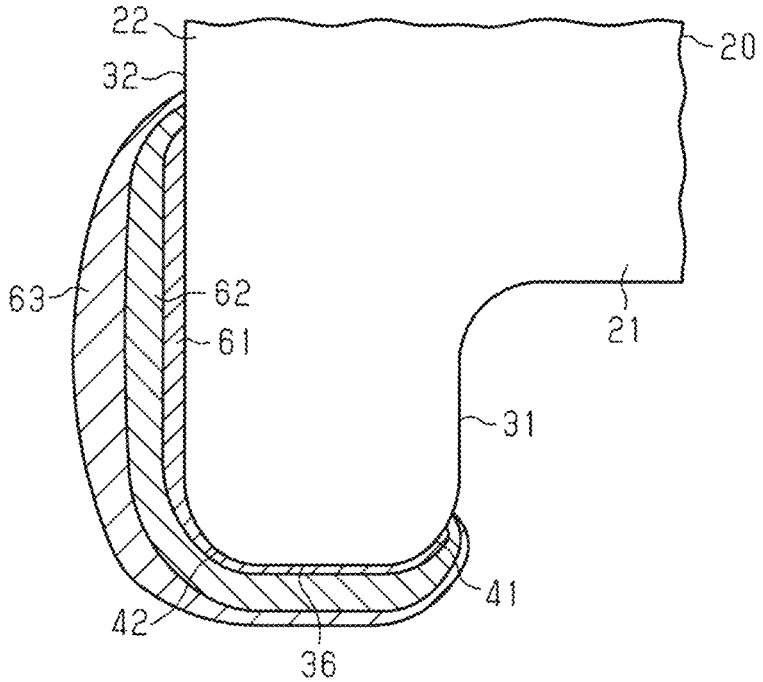
FIG. 5 is an enlarged sectional view of a terminal electrode.

As illustrated in FIG. 5, each terminal electrode 50 includes an underlying layer 61 on a surface of the core 20 and plated layers 62 and 63 that cover the underlying layer 61. The maximum thickness of a portion of the underlying layer 61 on the end face 32 is greater than the maximum thickness of a portion of the underlying layer 61 on the bottom face 36.

The underlying layer 61 is a metal layer containing, for example, silver (Ag) as a main component. The underlying layer 61 may additionally contain, for example, silica and resin. The plated layer 62 may be formed of, for example, a metal such as nickel (Ni) or copper (Cu), or an alloy such as Ni-chromium (Cr) or Ni—Cu. The plated layer 63 may be made of, for example, a metal such as tin (Sn).

The underlying layer 61 is formed by, for example, applying and baking a conductive paste. The plated layers 62 and 63 are formed by, for example, electroplating.

Figure 6A:
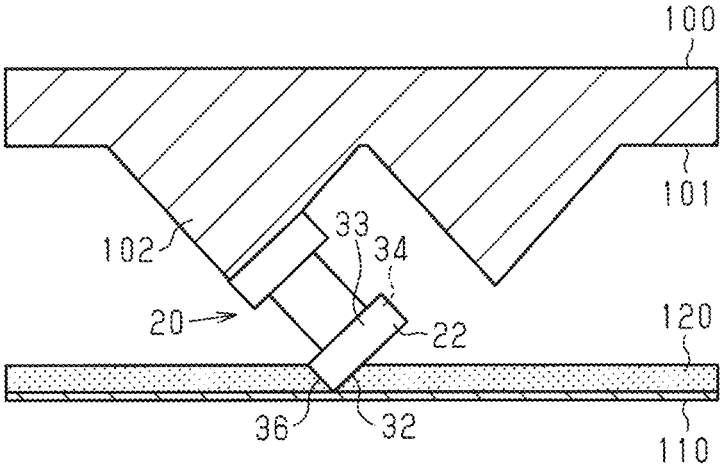
FIGS. 6A to 6C are schematic diagrams illustrating steps for forming the terminal electrode.
Figure 6B:
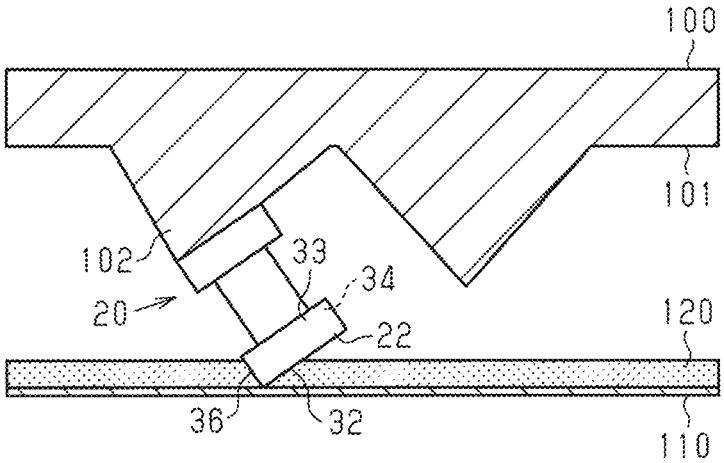
Figure 6C:
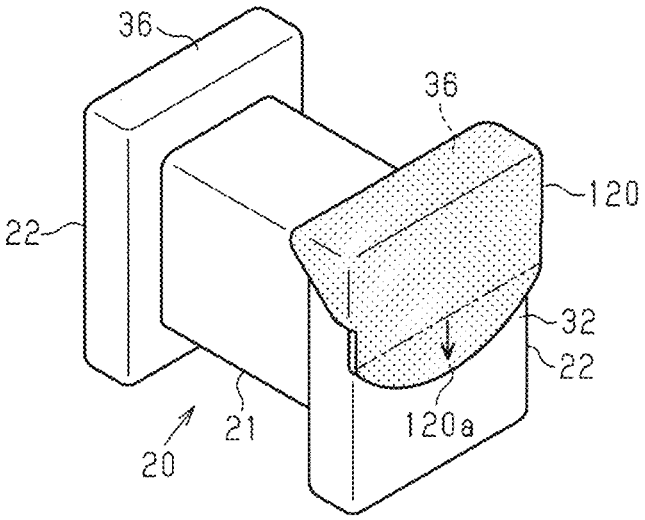

FIGS. 6A to 6C illustrate exemplary steps for forming the underlying layer 61 of each terminal electrode 50.

First, as illustrated in FIG. 6A, the core 20 is attached to a holder 100. The holder 100 includes a holding portion 102 that holds the core 20 with the axial direction of the core 20 inclined relative to a lower face 101 of the holder 100.

The holder 100 is adhesive and elastic, and holds the core 20 in a removable manner. The holder 100 may be made of, for example, silicone rubber.

Conductive paste 120 is contained in a reservoir 110. The conductive paste 120 is, for example, silver (Ag) paste. The bottom face 36 of one of the supports 22 of the core 20 is immersed in the conductive paste 120. At this time, the core 20 is brought into contact with the reservoir 110 in such a manner that the holder 100 is not deformed. In this step, the conductive paste 120 adheres to the side faces 33 and 34 and the end face 32 of the support 22 so as to be connected to the conductive paste on the bottom face 36. The conductive paste 120 adheres to the side faces 33 and 34 of the support 22 so that the height thereof from the bottom face 36 increases with increasing distance from the inner face 31 that opposes the inner face 31 of the other support 22 toward the end face 32.

Next, as illustrated in FIG. 6B, the holder 100 is pushed toward the reservoir 110. The holder 100 is elastic, and therefore allows a change in position of the core 20 held by the holder 100. The core 20 changes its position so as to change the inclination of the shaft 21 of the core 20. In the present embodiment, the core 20 is caused to change its position so that the shaft 21 of the core 20 becomes more perpendicular to the surface of the conductive paste 120. In this step, the conductive paste 120 adheres to the end face 32 of the support 22 so that the height thereof from the bottom face 36 of the support 22 is greater than that of the conductive paste 120 on the side faces 33 and 34. The top edge of the conductive paste 120 on the end face 32 is substantially straight.

Next, as illustrated in FIG. 6C, the core 20 is placed so that the bottom face 36 of the support 22 faces upward. The viscosity of the conductive paste 120 may be adjusted, for example, so that the conductive paste 120 on the end face 32 moves downward along the end face 32 from the position indicated by the two-dot chain line. The conductive paste 120 moves downward so that a central portion of a bottom edge 120*a* of the conductive paste 120 in the width direction reaches a lowest position. The conductive paste 120 is dried in this state. The conductive paste 120 is also applied to the other support 22 in a similar manner, and is dried. Then, the conductive paste on the core 20 is baked to form the underlying layer 61 (electrode film) illustrated in FIG. 5.

Then, the plated layers 62 and 63 illustrated in FIG. 5 are formed on the surface of the underlying layer 61 by, for example, electroplating. The terminal electrodes 50 are formed by the above-described steps.

As illustrated in FIG. 5, each terminal electrode 50 is formed so that the bottom electrode section 51 on the bottom face 36 of the support 22 and the end electrode section 52 on the end face 32 of the support 22 are connected to each other. The ridge 42 at the boundary between the bottom face 36 and the end face 32 of the support 22 is rounded. The radius of curvature of the ridge 42 is greater than or equal to about 20 μm (35 μm in the present embodiment). Such a ridge 42 facilitates formation of the terminal electrode 50 that continuously extends from the bottom face 36 of the support 22 to the end face 32 of the support 22.

When the core has a ridge 42 whose radius of curvature is less than about 20 μm or when the core does not have a rounded ridge 42, the thickness of the terminal electrode (underlying layer) on the ridge at the boundary between the bottom face and the end face is reduced, and the bottom electrode section and the end electrode section are easily disconnected. In contrast, when the radius of curvature of the ridge 42 is greater than or equal to about 20 μm, the terminal electrode 50 (underlying layer 61) has a sufficient thickness at the ridge 42. Therefore, the bottom electrode section 51 and the end electrode section 52 are not easily disconnected.

The wire 70 is wound around the shaft 21. The wire 70 includes, for example, a core having a substantially circular cross section and a cladding that covers the surface of the core. The core may be made of, for example, a material containing a conductive material, such as Cu and Ag, as a main component. The cladding may be made of, for example, an insulating material, such as polyurethane and polyester. Both end portions of the wire 70 are electrically connected to the respective terminal electrodes 50. The wire 70 may be connected to the terminal electrodes 50 by, for example, soldering. More specifically, the plated layer 63 of each terminal electrode 50 may be formed of a Sn layer, and the wire 70 may be connected to the terminal electrode 50 by thermally bonding a portion of the wire 70 in which the cladding is removed and the core is exposed to the plated layer 63. The connecting method is not limited to this, and various known methods may be used.

The diameter of the wire 70 is preferably in the range of, for example, about 14 μm to about 30 μm, and more preferably in the range of about 15 μm to about 28 μm. In the present embodiment, the diameter of the wire 70 is about 25 μm. When the diameter of the wire 70 is greater than a certain value, an increase in the resistance component can be suppressed. When the diameter of the wire 70 is less than a certain value, the wire 70 can be prevented from protruding from the core 20.

As illustrated in FIG. 1A, the wire 70 includes a wound portion 71 wound around the shaft 21, connected portions 72 connected to the terminal electrodes 50, and extending portions 73 that extend between the wound portion 71 and the connected portions 72. The connected portions 72 are connected to the bottom electrode sections 51 of the terminal electrodes 50, the bottom electrode sections 51 being formed on the bottom faces 36 of the supports 22.

The wire 70 is wound around the shaft 21 with spaces provided between the wire 70 and the supports 22. In other words, end portions 71*a* and 71*b* of the wound portion 71 are spaced from the supports 22 of the core 20. The distance Lb from the end portions 71*a* and 71*b* of the wound portion 71 to the supports 22 is preferably less than or equal to about 5 times the diameter of the wire 70, and more preferably less than or equal to about 4 times the diameter of the wire 70. In the present embodiment, the distance Lb between the wire 70 and the supports 22 is less than or equal to about 3 times the diameter of the wire 70.

The distance from the end portions 71*a* and 71*b* of the wound portion 71 to the supports 22 affects the length of the extending portions 73. The extending portions 73 connect the wound portion 71 to the connected portions 72, which are connected to the bottom electrode sections 51 of the terminal electrodes 50 formed on the supports 22. Therefore, when the end portions 71*a* and 71*b* of the wound portion 71 are spaced from the supports 22 by a large distance, the extending portions 73 are long and are spaced from the supports 22 and the shaft 21 by a large distance. In such a case, there is a risk that the extending portions 73 will be damaged or the wire 70 will break. There is also a risk that the wire 70 will be loosened due to the extending portions 73, protrude from the end portions of the supports 22, and be damaged. These risks can be reduced by appropriately setting the distance from the end portions 71*a* and 71*b* of the wound portion 71 to the supports 22.

As illustrated in FIG. 2, the inductor component 10 further includes a cover member 80. In FIGS. 1A and 1B, the cover member 80 is indicated by two-dot chain lines to provide better visibility of the core 20 and the wire 70.

The cover member 80 is disposed at least between the supports 22 so as to cover the wire 70 at the side near the top faces 35. More specifically, the cover member 80 extends from the top face 35 of one support 22 to the top face 35 of the other support 22 along the upper portion of the shaft 21. The cover member 80 has a substantially flat top face 81. The cover member 80 may be made of, for example, an epoxy resin.

In the present embodiment, the dimension of the cover member 80 in the length direction Ld in FIG. 1A (length dimension L2) is smaller than the length dimension L1 of the inductor component 10 including the terminal electrodes 50. The dimension of the cover member 80 in the width direction Wd in FIG. 1B (width dimension W2) is smaller than the width dimension W1 of the inductor component 10 including the terminal electrodes 50. In other words, in the present embodiment, the dimensions of a portion of the inductor component 10 around the top faces 35 of the core 20 (that is, the length dimension L2 and width dimension W2 of the cover member 80) are smaller than the dimensions of a portion of the inductor component 10 around the bottom faces 36 of the core 20 (the length dimension L1 and width dimension W1).

The cover member 80 enables reliable suction by a suction nozzle when, for example, the inductor component 10 is mounted on the circuit board. The cover member 80 also prevents the wire 70 from being damaged during suction by the suction nozzle. When the cover member 80 is made of a magnetic material, the inductance (L) of the inductor component 10 can be increased. When the cover member 80 is made of a non-magnetic material, magnetic loss can be reduced and the Q factor of the inductor component 10 can be increased.

Effects

The effects of the inductor component 10 due to the above-described structure thereof will now be described.

Each terminal electrode 50 of the inductor component 10 according to the present embodiment includes the bottom electrode section 51 on the bottom face 36 of the corresponding support 22, the side electrode sections 53 on the side faces 33 and 34 of the support 22, and the end electrode section 52 on the end face 32 of the support 22. The end portions 52*b* of the end electrode section 52 adjacent to the side faces 33 and 34 are higher than the end portions of the side electrode sections 53 adjacent to the end face 32. With this structure, the surface area of the terminal electrode 50 is increased. When the surface area is increased, the terminal electrode 50 can be strongly connected to the circuit board after the mounting process. In other words, the fixing force between the inductor component 10 and the circuit board can be increased.

The end electrode section 52 is higher at the central portion 52*a* than at the end portions 52*b* in the width direction Wd. Accordingly, the surface area of the end electrode section 52 is greater than that in the case where the central portion 52*a* and the end portions 52*b* have the same height. Thus, the terminal electrode 50 can be strongly connected to the circuit board. In other words, the fixing force between the inductor component 10 and the circuit board can be increased. Furthermore, the top edge 52*c* of the end electrode section 52 is substantially upwardly convex arc-shaped. When the top edge 52*c* is arc-shaped, the surface area of the terminal electrode 50 can be further increased.

When the inductor component 10 is soldered to pads formed on the circuit board, solder fillet extends along the central portion 52*a* of the end electrode section 52. Since the end electrode section 52 of the inductor component 10 is higher at the central portion 52*a* than at the end portions 52*b*, the height to which the solder extends can be increased. Thus, the inductor component 10 that is reduced in size can be sufficiently strongly fixed to the circuit board on which the inductor component 10 is to be mounted. The fixing force between the inductor component 10 and the circuit board may be, for example, greater than or equal to about 5.22 N.

In the present embodiment, the height dimension T1 of the inductor component 10 is greater than the width dimension W1 of the inductor component 10 (T1>W1). Therefore, the height of the end electrode section 52 can be increased relative to a certain mounting area, and the surface area of the end electrode section 52 can be further increased.

The terminal electrodes 50 according to the present embodiment are effective in achieving the inductance required of the inductor component 10. More specifically, the magnetic flux generated in the shaft 21 of the core 20 by the wire 70 extends from the shaft 21 so as to pass through one support 22, the air, and the other support 22, and returns to the shaft 21. In the inductor component 10 according to the present embodiment, the heights of the end portions 52*b* and the side electrode sections 53 connected to the end portions 52*b* are smaller than the height of the central portion 52*a*. Therefore, each terminal electrode 50 does not block the magnetic flux at most parts of the side faces 33 and 34 of the corresponding support 22 and the ridges between the end face 32 and the side faces 33 and 34, and causes less reduction in the total amount of magnetic flux. A reduction in the total amount of magnetic flux causes a reduction in the inductance, and therefore the desired inductance (inductance corresponding to the design of the core) cannot be obtained. According to the present embodiment, since the inductor component 10 causes less reduction in the total amount of magnetic flux, the inductance acquisition efficiency can be increased. For example, the inductance of the inductor component 10 may be greater than or equal to about 560 nH for an input signal having a frequency of about 10 MHz. In addition, since each terminal electrode 50 does not block the magnetic flux at most parts of the ridges as described above, the occurrence of eddy current loss in the terminal electrode 50 can be reduced. This leads to less reduction in the Q factor.

The terminal electrodes 50 include the side electrode sections 53 on the side faces 33 and 34 of the supports 22. The heights of the side electrode sections 53 gradually increase with increasing distances from the inner faces 31 toward the end faces 32 of the supports 22. In other words, the side electrode sections 53 are lower at the ends adjacent to the inner faces 31 than at the ends adjacent to the end faces 32. Therefore, even when the heights of the end electrode sections 52 are increased, the risk of interference between the wire 70 and solder in the regions near the inner faces 31 can be reduced in the mounting process.

Since the height of each side electrode section 53 is large at the end adjacent to the end face 32, the surface area of the side electrode section 53 is larger than that in the case where the side electrode section 53 has a constant height. Therefore, the fixing force between the inductor component 10 and the circuit board can be further increased. When the surface area of each side electrode section 53 is large, the thickness of the side electrode section 53 can be easily increased. Therefore, the width dimension W1 of the inductor component 10 including the core 20 and the terminal electrodes 50 is greater than the width dimension of the core 20 and the width dimension W2 of the cover member 80. The inductor component 10 having such a structure is not easily inclined with respect to the width direction Wd in the mounting process. Thus, the inductor component 10 can be easily placed in a stable position in the mounting process.

The width dimension of the upper portion of the inductor component 10, that is, the width dimension W2 of the cover member 80, is smaller than that of a mounting portion of the inductor component 10 (width dimension W1). Therefore, the gap between the upper portion of the inductor component 10 and a component mounted adjacent to the inductor component 10 can be increased at the top side. Thus, even when the inductor component 10 is inclined with respect to the width direction Wd when the inductor component 10 is soldered, the risk of interference between the inductor component 10 and the component adjacent thereto can be reduced.

Similarly, in the inductor component 10, since the height of each side electrode section 53 is large at the end adjacent to the end face 32, the area of the end electrode section 52 on the end face 32 is also larger than that in the case where the side electrode section 53 has a constant height. Therefore, the thickness of the end electrode section 52 can also be easily increased. Thus, the length dimension L1 of the inductor component 10 including the core 20 and the terminal electrodes 50 is greater than the length dimension of the core 20 and the length dimension L2 of the cover member 80. This also enables the inductor component 10 to be easily placed in a stable position in the mounting process.

When the thicknesses of the end electrode section 52 and the side electrode sections 53 are increased, the center of gravity of the inductor component 10 is lowered. This also enables the inductor component 10 to be easily placed in a stable position in the mounting process.

Figure 7A:
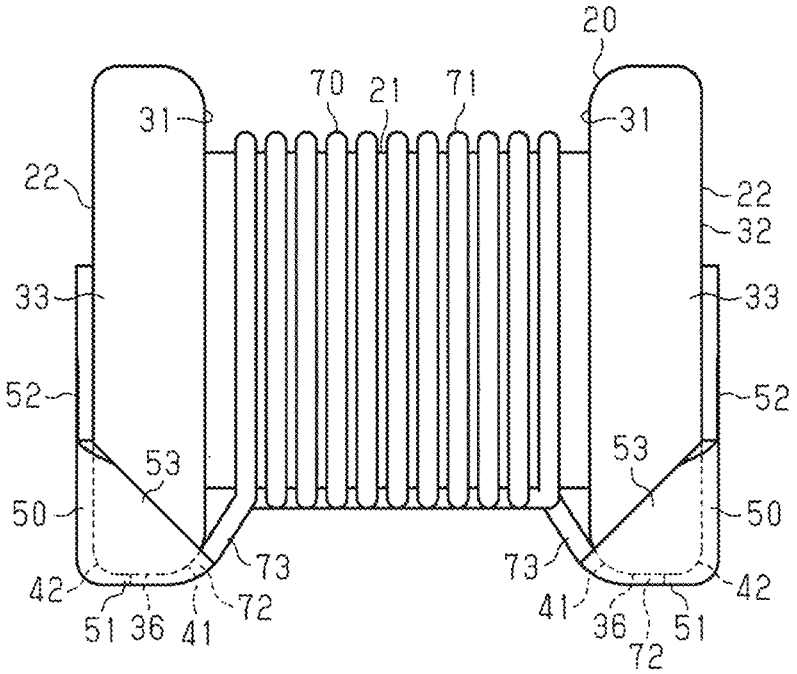
FIG. 7A is a side view of the inductor component according to the first embodiment.
Figure 7B:
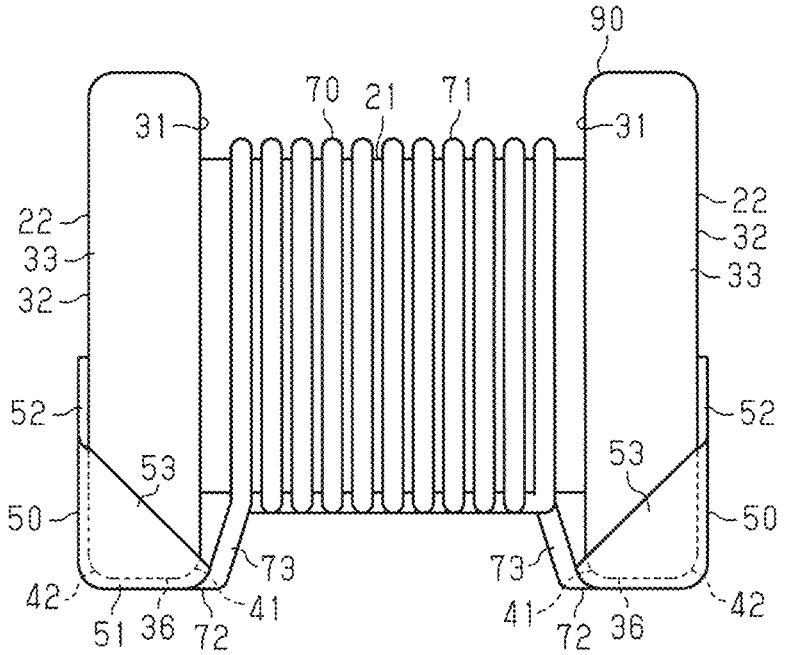
FIG. 7B is a side view of an inductor component of a comparative example.

FIG. 7B illustrates an inductor component including a core 90 according to a comparative example. In the comparative example, constituent members that are the same as those in the present embodiment are denoted by the same reference numerals to facilitate understanding of comparison between the comparative example and the present embodiment. In the core 90 of the comparative example, the ridges 41 adjacent to the inner faces 31 and the ridges 42 adjacent to the end faces 32 have the same radius of curvature (for example, 20 μm). In this case, the wire 70 is curved with a small radius of curvature at the ridges 41, and force is concentrated at the curved portions. Therefore, when the diameter of the wire 70 is less than or equal to a certain value (for example, about 25 μm), there is a risk that the wire 70 will break.

In contrast, in the core 20 included in the inductor component 10 according to the present embodiment illustrated in FIG. 7A, the radius of curvature of the ridges 41 adjacent to the inner faces 31 is greater than that of the ridges 42 adjacent to the end faces 32, and is, for example, about 40 μm. Therefore, the wire 70 is curved with a large radius of curvature at the ridges 41, and the concentration of force is reduced. Thus, breakage of the wire 70, for example, does not easily occur.

In addition, the extending portions 73 that extend between the shaft 21 and the terminal electrodes 50 (portions that are in midair and not in contact with the core 20) are shorter than those in the comparative example illustrated in FIG. 7B. When the extending portions 73 are long, there is a risk that the extending portions 73 will be damaged or the wire 70 will break. There is also a risk that the wire 70 will be loosened due to the extending portions 73, protrude from the end portions of the supports 22, and be damaged. In the present embodiment, these risks can be reduced because the extending portions 73 are shorter than those in the comparative example.

As described above, when the radius of curvature of the ridges 41 is greater than a certain value, the risk of breakage of the wire 70, for example, can be reduced. However, when the radius of curvature of the ridges 41 is smaller than a certain value, the area of the bottom faces 36 of the supports 22 can be increased, so that the inductor component 10 can be stably mounted.

As described above, the present embodiment has the following effects.

(1-1) The inductor component 10 includes the core 20, the pair of terminal electrodes 50, and the wire 70. The core 20 includes the shaft 21 and the pair of supports 22. The shaft 21 is substantially rectangular parallelepiped shaped. The supports 22 are provided at both ends of the shaft 21. The wire 70 is wound around the shaft 21, and both end portions thereof are connected to the terminal electrodes 50 on the respective supports 22.

Each terminal electrode 50 includes the bottom electrode section 51 on the bottom face 36 of the corresponding support 22, the side electrode sections 53 on the side faces 33 and 34 of the support 22, and the end electrode section 52 on the end face 32 of the support 22. The end portions 52*b* of the end electrode section 52 adjacent to the side faces 33 and 34 are higher than the end portions of the side electrode sections 53 adjacent to the end face 32. With this structure, the surface area of the terminal electrode 50 is increased. When the surface area is increased, the terminal electrode 50 can be strongly connected to the circuit board after the mounting process. In other words, the fixing force between the inductor component 10 and the circuit board can be increased. Accordingly, even when, for example, the inductor component 10 is reduced in size, the inductor component 10 can be sufficiently strongly fixed to the circuit board on which the inductor component 10 is to be mounted.

(1-2) The end electrode section 52 is higher at the central portion 52*a* than at the end portions 52*b* in the width direction Wd. Accordingly, the surface area of the end electrode section 52 is greater than that in the case where the central portion 52*a* and the end portions 52*b* have the same height. Thus, the terminal electrode 50 can be strongly connected to the circuit board. In other words, the fixing force between the inductor component 10 and the circuit board can be increased. Furthermore, the top edge 52*c* of the end electrode section 52 is substantially upwardly convex arc-shaped. Thus, the surface area of the end electrode section 52 can be further increased. In other words, the surface area of the terminal electrode 50 can be further increased.

(1-3) The height dimension T1 of the inductor component 10 is greater than the width dimension W1 of the inductor component 10 (T1>W1). Therefore, the height of the end electrode section 52 can be increased relative to a certain mounting area, and the surface area of the end electrode section 52 can be further increased.

(1-4) The magnetic flux generated in the shaft 21 of the core 20 by the wire 70 extends from the shaft 21 so as to pass through one support 22, the air, and the other support 22, and returns to the shaft 21. In the inductor component 10 according to the present embodiment, the heights of the end portions 52*b* and the side electrode sections 53 connected to the end portions 52*b* are smaller than the height of the central portion 52*a*. Therefore, each terminal electrode 50 does not block the magnetic flux at most parts of the side faces 33 and 34 of the corresponding support 22 and the ridges between the end face 32 and the side faces 33 and 34, and causes less reduction in the total amount of magnetic flux. A reduction in the total amount of magnetic flux causes a reduction in the inductance, and therefore the desired inductance (inductance corresponding to the design of the core) cannot be obtained. According to the present embodiment, since the inductor component 10 causes less reduction in the total amount of magnetic flux, the inductance acquisition efficiency can be increased. In addition, since each terminal electrode 50 does not block the magnetic flux at most parts of the ridges of the support 22, the occurrence of eddy current loss in the terminal electrode 50 can be reduced. This leads to less reduction in the Q factor.

(1-5) The heights of the side electrode sections 53 increase with increasing distances from the opposing inner faces 31 toward the end faces 32 of the supports 22. Thus, the terminal electrodes 50 are lower at the inner faces 31 than at the end faces 32. Therefore, even when the heights of the end electrode sections 52 are increased, the risk of interference between the wire 70 and solder in the regions near the inner faces 31 can be reduced in the mounting process. In addition, since the side electrode sections 53 are high at the ends adjacent to the end faces 32 and have a large surface area, the terminal electrodes 50 can be strongly connected to the circuit board. In other words, the fixing force between the inductor component 10 and the circuit board can be increased.

(1-6) Each support 22 includes the rounded ridge 41 at the boundary between the inner face 31 and the bottom face 36, and the rounded ridge 42 at the boundary between the end face 32 and the bottom face 36. The radius of curvature of the ridge 42 is greater than or equal to about 20 μm, and the radius of curvature of the ridge 41 is greater than the radius of curvature of the ridge 42. The wire 70 is wound around the shaft 21, and the connected portions 72 thereof are connected to the bottom electrode sections 51 of the terminal electrodes 50. Thus, the wire 70 extends from the bottom face 36 of each support 22 to the shaft 21. Since the ridge 41 of the support 22 at the boundary between the bottom face 36 and the inner face 31 has a large radius of curvature, the wire 70 is curved with a large radius of curvature at the ridge 41. Thus, the occurrence of breakage of the wire 70 can be reduced.

(1-7) Each terminal electrode 50 includes the underlying layer 61 on the surface of the corresponding support 22 and the plating layers 62 and 63 on the surface of the underlying layer 61. The maximum thickness of the underlying layer 61 on the end face 32 is greater than the maximum thickness of the underlying layer 61 on the bottom face 36. With this structure, the adhesion between the underlying layer 61 on the end face 32 and the end face 32 can be increased, and the surface area of the end electrode section 52 can be further increased. Therefore, separation of the terminal electrode 50, for example, can be reduced, and the fixing force between the inductor component 10 and the circuit board can be increased. The underlying layer 61 on the bottom face 36 receives load when the wire 70 is connected thereto, and the adhesion thereof is increased accordingly. Therefore, the underlying layer 61 is not easily separated even when the thickness thereof is relatively small.

Second Embodiment

A second embodiment will now be described.

In this embodiment, constituent members that are the same as those in the above-described embodiment are denoted by the same reference numerals, and description thereof may be partially or entirely omitted.

Figure 8B:
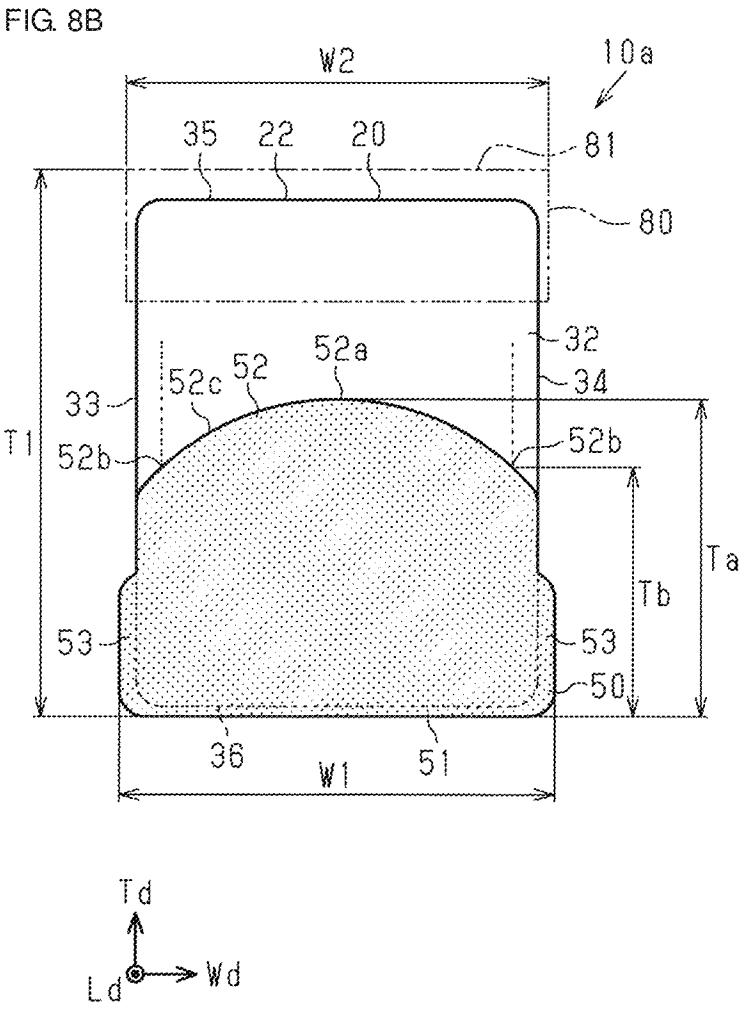
FIG. 8B is an end view of the inductor component according to the second embodiment.
Figure 8A:
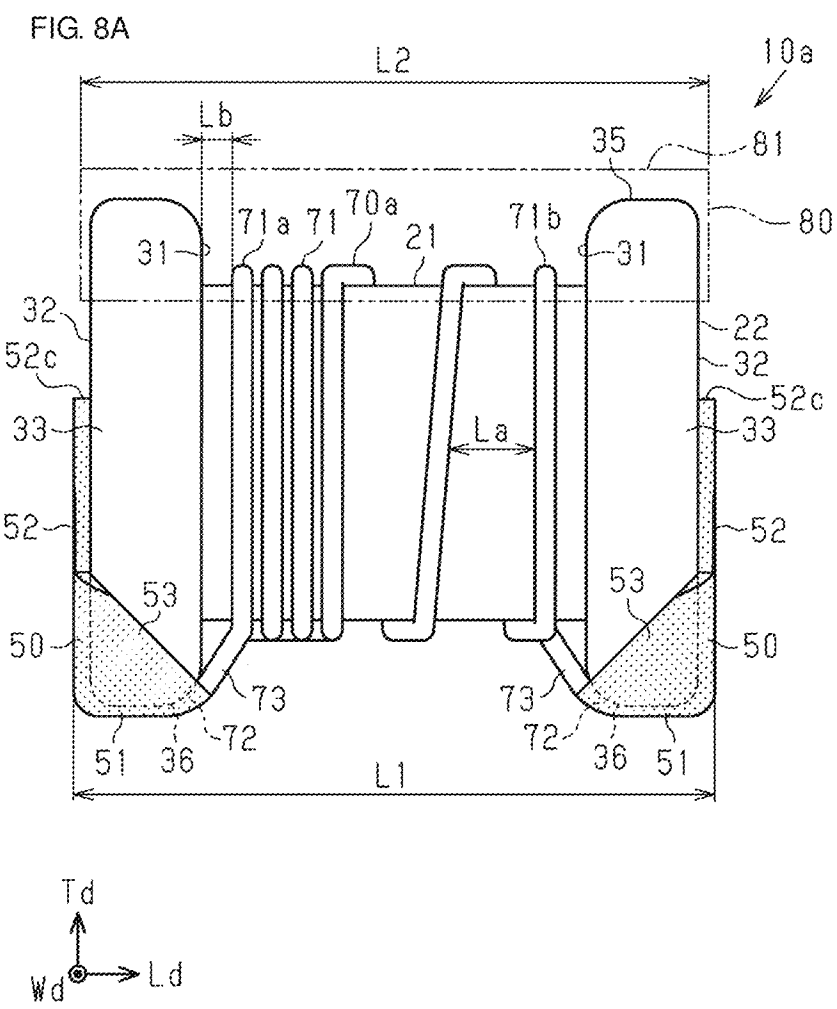
FIG. 8A is a front view of an inductor component according to a second embodiment.
Figure 9:
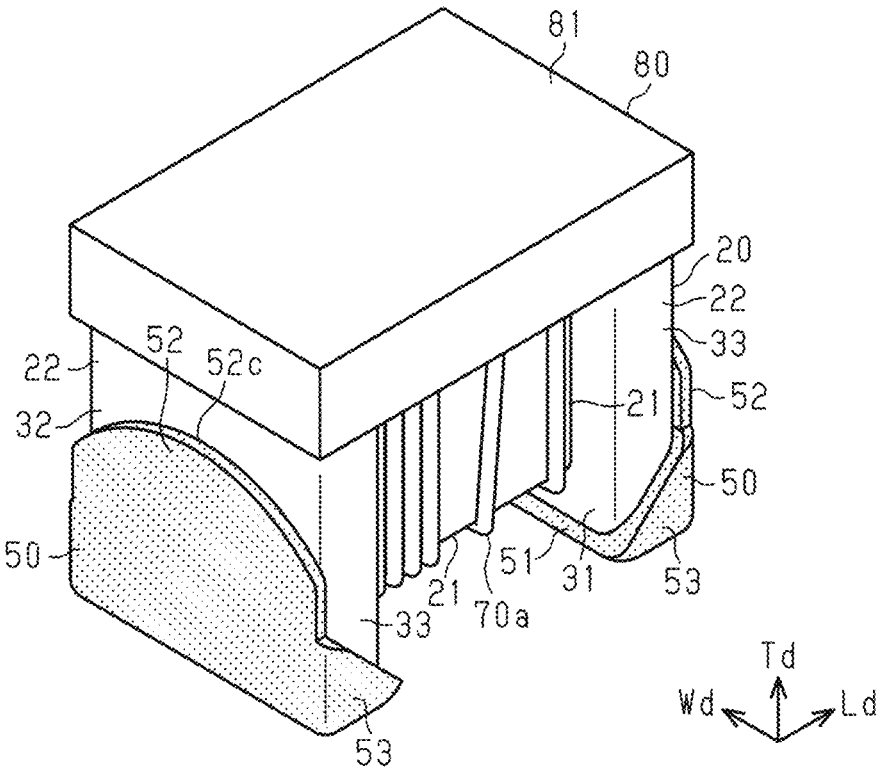
FIG. 9 is a perspective view of the inductor component according to the second embodiment.

An inductor component 10*a* illustrated in FIGS. 8A, 8B, and 9 includes the core 20, the pair of terminal electrodes 50, and a wire 70*a*. The wire 70*a* is wound around the shaft 21 so as to form a single layer on the shaft 21. Both end portions of the wire 70*a* are connected to the respective terminal electrodes 50. The inductor component 10*a* is a wire-wound inductor component.

As illustrated in FIG. 8A, the wire 70*a* includes a wound portion 71 wound around the shaft 21, connected portions 72 connected to the terminal electrodes 50, and extending portions 73 that extend between the wound portion 71 and the connected portions 72. The connected portions 72 are connected to the bottom electrode sections 51 of the terminal electrodes 50, the bottom electrode sections 51 being formed on the bottom faces 36 of the supports 22.

The wound portion 71 includes at least one section in which the distance between adjacent turns in the length direction Ld (single turn is a part of the wound portion 71 that extends around the shaft 21 once) is greater than or equal to a predetermined value. The predetermined value is, for example, preferably greater than or equal to about 0.5 times the diameter of the wire 70*a*, and more preferably greater than or equal to about 1 times the diameter of the wire 70*a*. In the present embodiment, the distance La between the turns indicated by an arrow in FIG. 8A is greater than or equal to about 2 times the diameter of the wire 70*a*. Thus, the wound portion 71 of the present embodiment includes at least one section in which the distance between the adjacent turns of the wire 70*a* is greater than or equal to about 2 times the diameter of the wire 70*a*.

A parasitic capacitance is generated between the adjacent turns of the wound portion 71 in the axial direction of the shaft 21. The value of the parasitic capacitance is determined by the distance between the adjacent turns. As the distance between the adjacent turns increases, the value of the parasitic capacitance decreases. In other words, the influence of the parasitic capacitance can be reduced, which leads to a less reduction in the self-resonance frequency (SRF). Thus, the inductor component 10*a* according to the present embodiment may have an SRF of greater than or equal to about 3.6 GHz.

For example, the inductor component 10*a* has electrical characteristics such that the impedance thereof is greater than or equal to about 500Ω for an input signal having a frequency of about 3.6 GHz. The impedance of the inductor component 10*a*, which is determined based on the frequency of the input signal, is preferably greater than or equal to about 300Ω at a frequency of about 1.0 GHz and greater than or equal to about 400Ω at a frequency of about 1.5 GHz, more preferably greater than or equal to about 450 S at a frequency of about 2.0 GHz, and still more preferably greater than or equal to about 500Ω at a frequency of about 4.0 GHz. When the impedance is greater than or equal to a certain value at a specific frequency, noise reduction (choke), resonance (bandpass), and impedance matching can be realized at that frequency.

The inductance of the inductor component 10*a* is preferably about 40 nH to about 70 nH. When the inductance is greater than or equal to about 40 nH, an impedance of greater than or equal to a certain value can be obtained. When the inductance is less than or equal to about 70 nH, a high SRF can be obtained. In the present embodiment, the inductance of the inductor component 10*a* is, for example, about 60 nH. The above-mentioned inductances are based on an input signal having a frequency of about 10 MHz.

The SRF of the inductor component 10*a* is preferably greater than or equal to about 3.0 GHz, more preferably greater than or equal to about 3.2 GHz, and still more preferably greater than or equal to about 3.4 GHz. Thus, the function of the inductor component can be obtained in a high-frequency band.

The operation of the above-described inductor component 10*a* will now be described.

Figure 10:
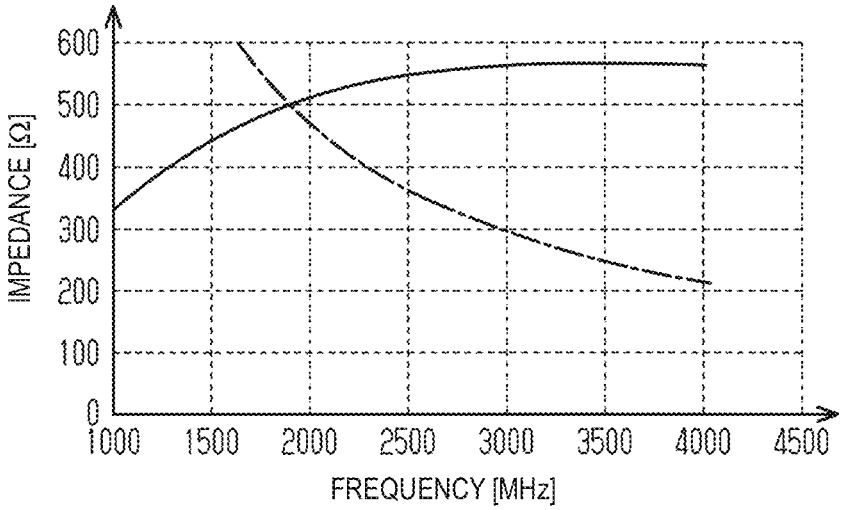
FIG. 10 is a graph showing the frequency-impedance characteristics of the inductor component according to the second embodiment.

FIG. 10 is a graph showing the frequency-impedance characteristics. In FIG. 10, the solid line represents the characteristics of the inductor component 10*a* according to the present embodiment, and the one-dot chain line represents the characteristics of an inductor component according to a comparative example.

The inductor component according to the comparative example includes a core having the same size and shape as the core 20 of the inductor component 10*a* according to the present embodiment, and a wire having the same thickness as the wire 70*a* of the present embodiment, the wire being densely wound around the core. In other words, the wire of the inductor component according to the comparative example includes a wound portion that is wound around the shaft of the core so that adjacent turns are close to each other in the length direction Ld. The inductor component according to the comparative example has an inductance of, for example, about 560 nH, and an SRF of less than or equal to about 1.5 GHz.

In general, an inductor component functions mainly as a capacitive element at a frequency higher than the SRF. Therefore, as illustrated in FIG. 10, the impedance of the inductor component according to the comparative example decreases in a range in which the frequency is greater than or equal to about 1.5 GHz.

In contrast, the impedance of the inductor component 10*a* according to the present embodiment is greater than or equal to about 400Ω for an input signal having a frequency of greater than or equal to about 1.5 GHz. The impedance is greater than or equal to about 500Ω when the frequency is greater than or equal to about 2.0 GHz. This is because the SRF of the inductor component 10*a* according to the present embodiment is greater than or equal to about 3.6 GHz.

As described above, the present embodiment has the following effects in addition to the effects of the above-described first embodiment.

(2-1) The inductor component 10*a* includes the core 20, the pair of terminal electrodes 50, and the wire 70*a*.

The wire 70*a* is wound around the shaft 21 so as to form a single layer on the shaft 21. Both end portions of the wire 70*a* are connected to the respective terminal electrodes 50. The wire 70*a* includes the wound portion 71 wound around the shaft 21, the connected portions 72 connected to the terminal electrodes 50, and the extending portions 73 that extend between the wound portion 71 and the connected portions 72. The connected portions 72 are connected to the bottom electrode sections 51 of the terminal electrodes 50, the bottom electrode sections 51 being formed on the bottom faces 36 of the supports 22. The wound portion 71 includes at least one section in which the distance between adjacent turns in the length direction Ld (single turn is a part of the wound portion 71 that extends around the shaft 21 once) is greater than or equal to a predetermined value. The inductor component 10*a* has electrical characteristics such that the impedance thereof is greater than or equal to about 500Ω for an input signal having a frequency of about 3.6 GHz. Thus, the inductor component 10*a* having a desired function in a high-frequency range can be provided.

Modifications

Each of the above-described embodiments may be implemented in the following manner.

In each of the above-described embodiments, the shape of the terminal electrodes may be changed as appropriate.

Although the top edge of each side electrode section 53 is substantially straight in each of the above-described embodiments, the top edge may have another shape.

Figure 11:
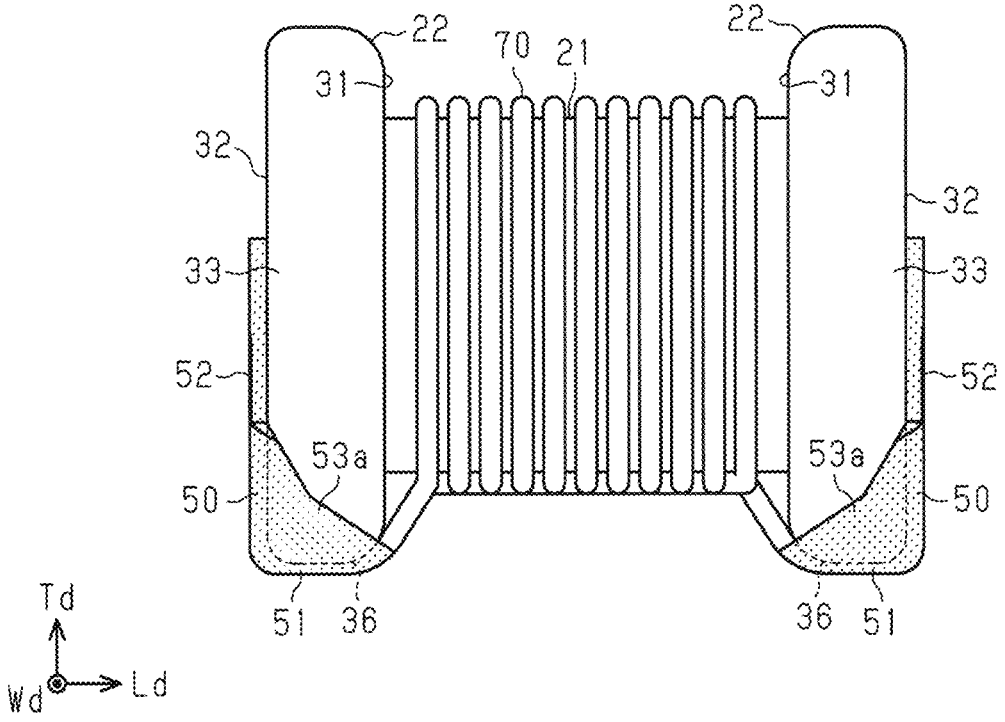
FIG. 11 is a side view of an inductor component according to a modification.

Side electrode sections 53*a* illustrated in FIG. 11 each include two portions having different inclinations. Among the two portions, the portion adjacent to the end face 32 has an inclination greater than that of the portion adjacent to the inner face 31.

Figure 12:
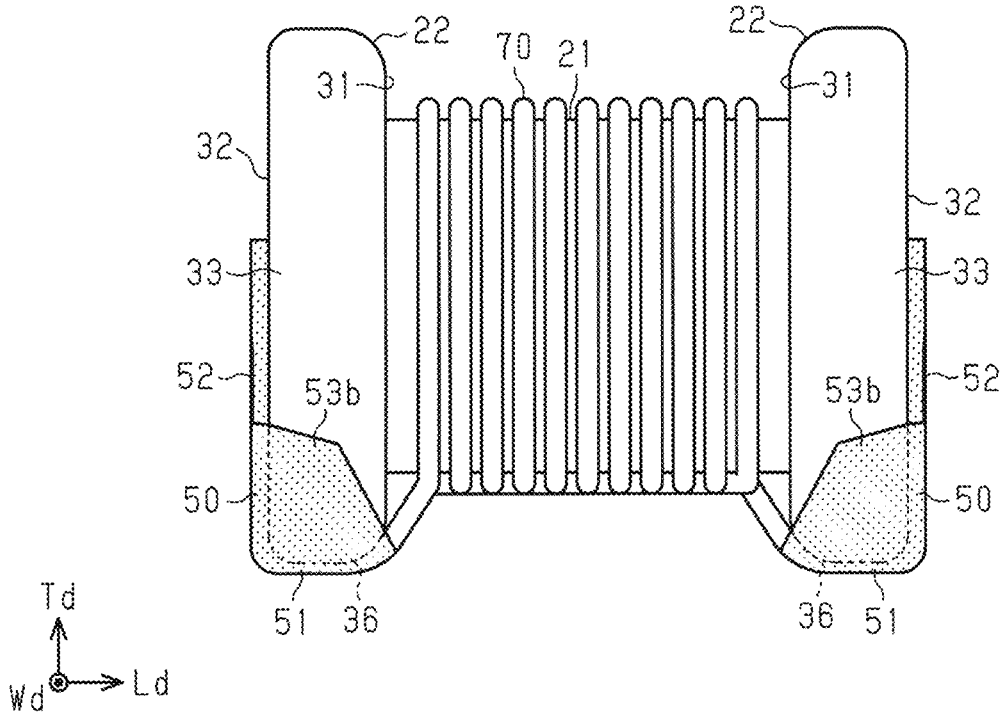
FIG. 12 is a side view of an inductor component according to another modification.

Side electrode sections 53*b* illustrated in FIG. 12 each include two portions having different inclinations. Among the two portions, the portion adjacent to the inner face 31 has an inclination greater than that of the portion adjacent to the end face 32. The side electrode sections 53*a* and 53*b* increase the design flexibility of the terminal electrodes of the inductor component and the land pattern on the circuit board.

Figure 13:
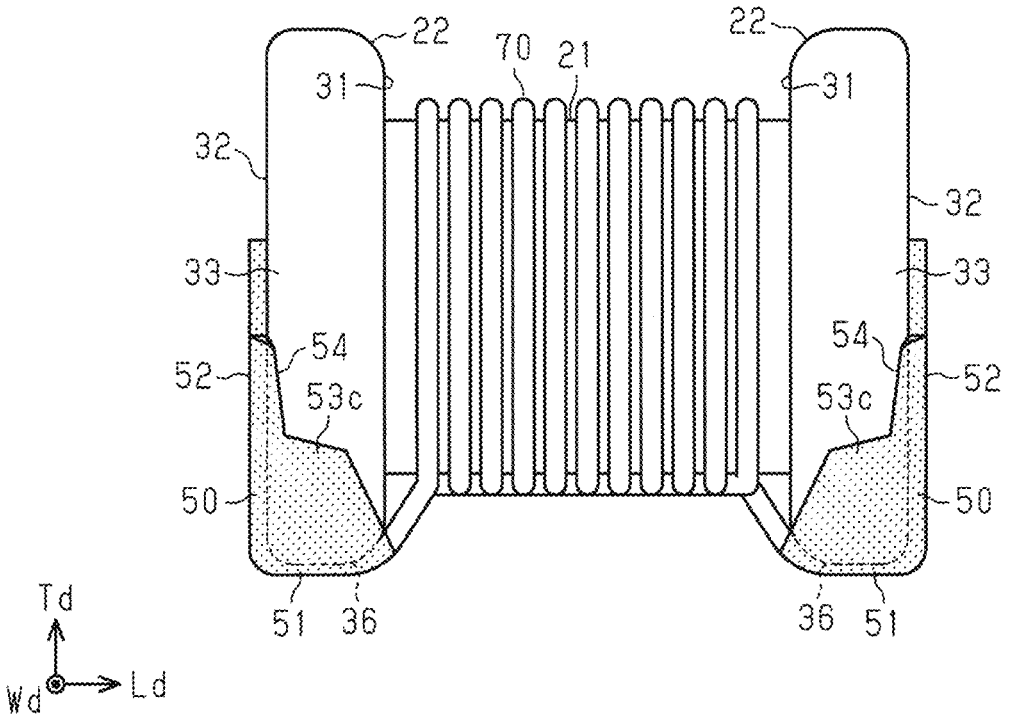
FIG. 13 is a side view of an inductor component according to another modification.

Side electrode sections 53*c* illustrated in FIG. 13 each include two portions having different inclinations similar to those of each side electrode section 53*b*. In addition, each terminal electrode 50 includes a ridge electrode section 54 disposed between the side electrode section 53*c* and the end electrode section 52 on the ridge at the boundary between the side face 33 and the end face 32. The ridge electrode section 54 has an inclination greater than that of the side electrode section 53*c*. In this structure, the end electrode section 52 can be formed so that the surface area thereof is larger than that in the structure without the ridge electrode section 54.

In the above-described embodiments, the terminal electrodes 50 on the supports 22 (first support and second support) provided at the respective end portions of the shaft 21 have the same shape. However, the terminal electrode 50 on the first support and the terminal electrode 50 on the second support may have different shapes. In addition, although the side electrode sections 53 are shaped so that the heights thereof gradually increase with increasing distances from the inner faces 31 of the supports 22 toward the end faces 32 of the supports 22, the shapes of the side electrode sections are not limited to this, and may instead be such that the heights thereof are partially reduced. Furthermore, the number of portions of each side electrode section having different inclinations is not limited to two, and may instead be three or more. Also, each side electrode section may further include a curved portion in a region outside the inclined portions. The side electrode sections on both sides of each support may include top edges having different shapes. In addition, the side electrode sections on one of the supports and the side electrode sections on the other support may have different inclination angles.

Figure 14:
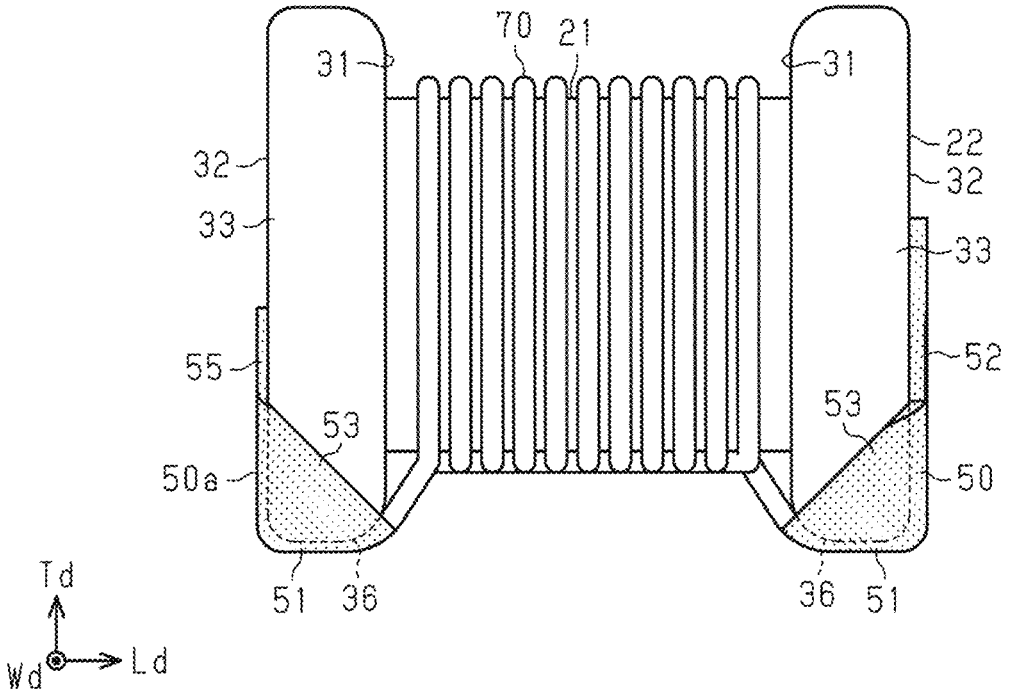
FIG. 14 is a side view of an inductor component according to another modification.

Referring to FIG. 14, the terminal electrode 50 on the first support (support 22 on the right side in FIG. 14) among the pair of supports 22 is formed such that, as in the above-described embodiment, the end portion 52*b* (see FIG. 1B) of the end electrode section 52 adjacent to the side face 33 is higher than the end portion of the side electrode section 53 adjacent to the end face 32. In this case, for example, a terminal electrode 50*a* on the second support (support 22 on the left side in FIG. 14) among the pair of supports 22 may be formed such that the height of an end portion of an end electrode section 55 adjacent to the side face 33 is substantially equal to that of the end portion of the side electrode section 53 adjacent to the end face 32.

In the first embodiment, the shape of the cover member 80 may be changed as appropriate.

Figure 15:
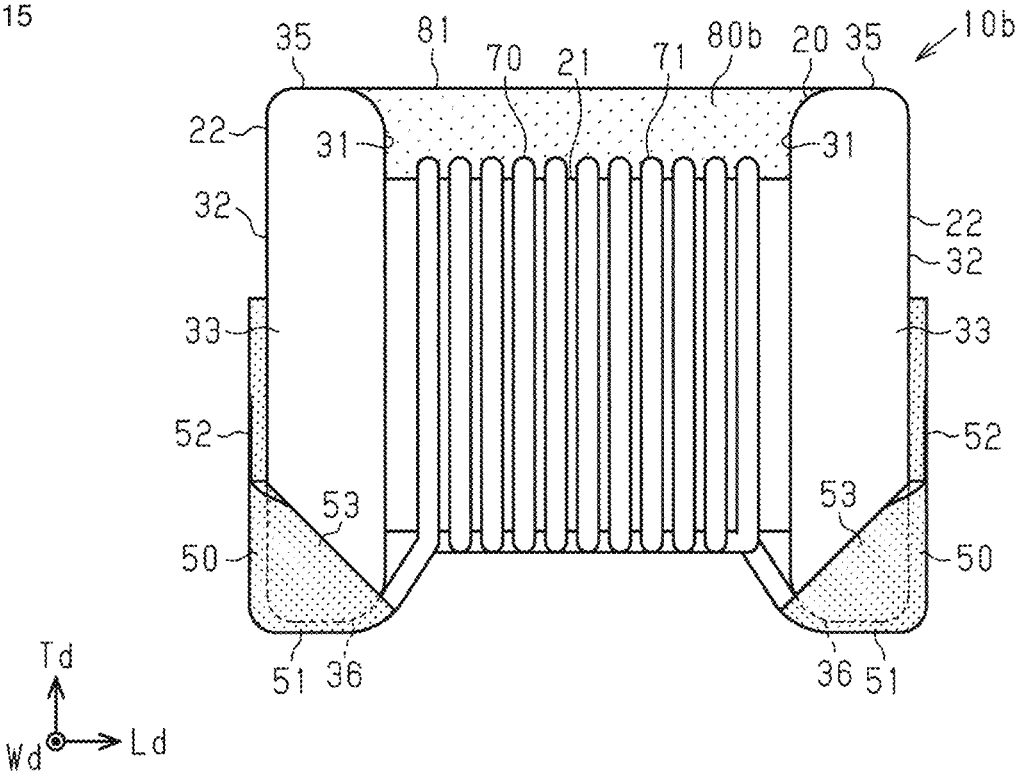
FIG. 15 is a side view of an inductor component according to another modification.

An inductor component 10*b* illustrated in FIG. 15 includes a cover member 80*b* that does not cover the top faces 35 of the supports 22 but covers an upper face of the shaft 21. More specifically, the cover member 80*b* is formed so as to cover the wire 70 (wound portion 71) wound around the shaft 21. The cover member 80*b* has a substantially flat top face 81. The top faces 35 of the supports 22 are exposed. In this structure, the length and width dimensions of the inductor component 10*b* at the top side are substantially equal to the length and width dimensions of the core 20.

The cover member may instead be formed so as to cover only portions of the wire 70 that are between the supports 22 and around an upper portion of the shaft 21. Alternatively, the cover member may be formed so as to cover only portions of the wire 70 on the upper face and both side faces of the shaft 21. Alternatively, the cover member may be formed so as to cover the entirety of the wound portion 71 of the wire 70. The cover member 80 may be omitted. This also applies to the second embodiment.

In each of the above-described embodiments, the shape of the core 20 may be changed as appropriate.

Figure 16:
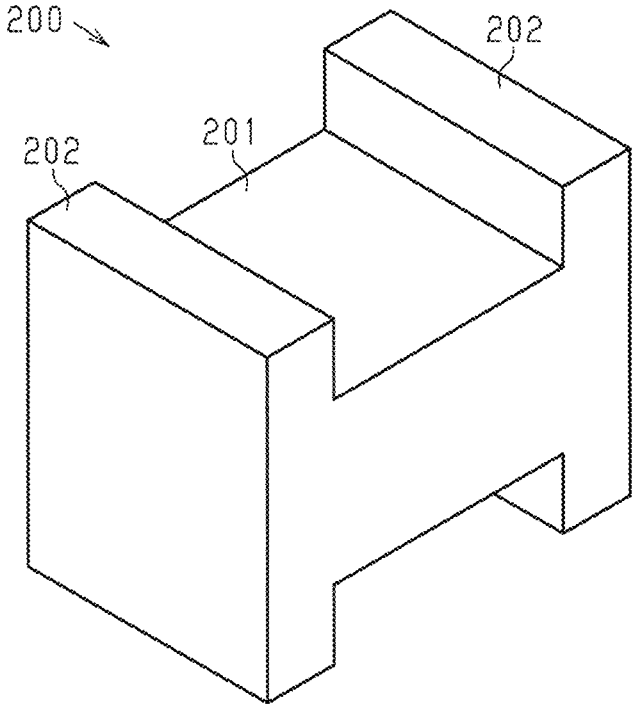
FIG. 16 is a schematic perspective view of a core according to another modification.

FIG. 16 illustrates a core 200 including a substantially rectangular-parallelepiped-shaped shaft 201 and supports 202 provided at respective end portions of the shaft 201. Each support 202 has the same width as the shaft 201, and extends upward and downward from the shaft 201. Thus, the core 200 has H-shaped side faces. The core 200 illustrated in FIG. 16 is an example, and the shapes of the shaft 201 and the supports 202 may be changed as appropriate.

In the above-described second embodiment, the inductor component having an impedance of greater than or equal to about 500Ω for an input signal having a frequency of about 3.6 GHz is not limited to that having the structures of the above-described inductor component 10*a* according to the embodiment. The above-described characteristics may also be obtained by changing, selecting, or combining the structures as appropriate.

In the above-described embodiments, the elastic holder 100 is used to form the underlying layer 61 of each terminal electrode 50 on the core 20 by changing the angle of the core 20. However, the underlying layer may instead be formed on the core in multiple steps. For example, the underlying layer 61 of each terminal electrode 50 may be formed on the core by dipping the core in the conductive paste 120 by using two holders having different inclinations.

In each of the above-described embodiments, the height dimension T1 of the inductor component 10 is greater than the width dimension W1 of the inductor component 10. However, the width dimension W1 and the height dimension T1 of the inductor component may instead be equal.

The structures of the above-described embodiments and modifications may be changed, selected, or combined as appropriate. The structure of a part of the embodiments or modifications may be combined with the structure of another part.

While some embodiments of the disclosure have been described above, it is to be understood that variations and modifications will be apparent to those skilled in the art without departing from the scope and spirit of the disclosure.

What is claimed is:

1. An inductor component comprising:

a core including a substantially column-shaped shaft and a support formed on an end portion of the shaft;

a terminal electrode formed on the support, the terminal electrode including a bottom electrode section on a bottom face of the support, a side electrode section on a side face of the support, and an end electrode section on an end face of the support;

a wire wound around the shaft and including an end portion connected to the terminal electrode; and a cover member that covers at least an upper face of the shaft and extends outwardly past a top surface of the support in a width direction, wherein a width dimension of the inductor component including the core and the terminal electrode is greater than a width dimension of the cover member.

2. The inductor component according to claim 1, wherein a length dimension of the inductor component including the core and the terminal electrode is greater than a length dimension of the cover member.

3. The inductor component according to claim 1, wherein the cover member covers the top face of the support.

4. The inductor component according to claim 1, wherein a length dimension of the inductor component including the core and the terminal electrode is less than or equal to about 1.0 mm, a width dimension of the inductor component including the core and the terminal electrode is less than or equal to about 0.6 mm, and a height dimension of the inductor component including the core and the terminal electrode is less than or equal to about 0.8 mm.

5. The inductor component according to claim 1, wherein a height dimension of the inductor component including the core and the terminal electrode is greater than a width dimension of the inductor component including the core and the terminal electrode.

6. The inductor component according to claim 1, wherein an end portion of the end electrode section adjacent to the side face is higher than an end portion of the side electrode section adjacent to the end face.

7. The inductor component according to claim 6, wherein a central portion of the end electrode section is higher than the end portion of the end electrode section.

8. The inductor component according to claim 7, wherein a top edge of the end electrode section is substantially upwardly convex arc-shaped.

9. The inductor component according to claim 6, wherein a height of the side electrode section increases from an inner face of the support toward the end face of the support.

10. The inductor component according to claim 1, wherein:

the support includes a first ridge that is rounded at a boundary between an inner face of the support and the bottom face, and a second ridge that is rounded at a boundary between the bottom face and the end face, and a radius of curvature of the first ridge is greater than the radius of curvature of the second ridge.

11. The inductor component according to claim 10, wherein the radius of curvature of the first ridge is greater than the radius of curvature of the second ridge by an amount greater than or equal to about 9% of the radius of curvature of the second ridge.

12. The inductor component according to claim 10, wherein the inner face of the support is vertical between the first ridge and the shaft.

13. The inductor component according to claim 10, wherein:

the support includes a third ridge that is rounded at a boundary between a top face of the support and the inner face, and a fourth ridge that is rounded at a boundary between the top face and the end face, and a radius of curvature of the third ridge is greater than a radius of curvature of the fourth ridge.

14. The inductor component according to claim 1, wherein:

the terminal electrode includes an underlying layer on a surface of the support and a plated layer on a surface of the underlying layer, and a maximum thickness of the underlying layer on the end face of the support is greater than a maximum thickness of the underlying layer on the bottom face of the support.

15. The inductor component according to claim 14, wherein the support has a ridge that is rounded at a boundary between the bottom face and the end face, and a radius of curvature of the ridge is greater than or equal to about 20 μm.

16. The inductor component according to claim 1, wherein:

the core includes another support that is formed on another end portion of the shaft, and the inductor component further comprises another terminal electrode formed on the another support, and wherein the terminal electrode on the support and the another terminal electrode on the another support have different shapes.

17. The inductor component according to claim 1, wherein an end portion of the side electrode section adjacent to the end face is higher than a bottom face of the shaft.

18. The inductor component according to claim 1, wherein the side electrode section includes two portions having different inclinations, and an inclination of one of the two portions that is adjacent to the end face is greater than an inclination of other of the two portions that is adjacent to an inner face of the support.

19. The inductor component according to claim 1, wherein the side electrode section includes two portions having different inclinations, and an inclination one of the two portions that is adjacent to an inner face of the support is greater than an inclination of other of the two portions that is adjacent to the end face.

20. The inductor component according to claim 1, wherein the terminal electrode includes a ridge electrode section between the side electrode section and the end electrode section on a ridge at a boundary between the side face and the end face, the ridge electrode section having an inclination greater than an inclination of the side electrode section.

* * * * *